US007431428B2

(12) United States Patent
Yamada

(10) Patent No.: US 7,431,428 B2
(45) Date of Patent: Oct. 7, 2008

(54) IMAGE FORMING APPARATUS INCLUDING LINE HEAD

(75) Inventor: Takahisa Yamada, Hachioji (JP)

(73) Assignee: Olympus Corporation, Tokyo (JP)

( * ) Notice: Subject to any disclaimer, the term of this patent is extended or adjusted under 35 U.S.C. 154(b) by 405 days.

(21) Appl. No.: 11/342,379

(22) Filed: Jan. 27, 2006

(65) Prior Publication Data

US 2006/0170732 A1 Aug. 3, 2006

(30) Foreign Application Priority Data

Jan. 31, 2005 (JP) ..... 2005-024388

(51) Int. Cl.
*B41J 2/14* (2006.01)
*B41J 2/16* (2006.01)

(52) U.S. Cl. ..... 347/49; 347/40; 347/85

(58) Field of Classification Search ..... 347/20, 347/22, 29, 40, 42, 49, 68, 70–72, 84–87
See application file for complete search history.

(56) References Cited

U.S. PATENT DOCUMENTS 6,736,492 B2 * 5/2004 Yamada et al. ..... 347/71
7,077,501 B2 * 7/2006 Kitahara et al. ..... 347/40

FOREIGN PATENT DOCUMENTS

JP 2001-322292 A 11/2001
JP 2004-306261 A 11/2004

* cited by examiner

*Primary Examiner*—Juanita D Stephens
(74) *Attorney, Agent, or Firm*—Frishauf, Holtz, Goodman & Chick, P.C.

(57) ABSTRACT

An image forming apparatus has a recording head portion constituted of head modules having a configuration in which a plurality of small heads are detachably attached in a head mount at alternate positions in a recording medium width direction and a drive portion is also mounted.

10 Claims, 21 Drawing Sheets

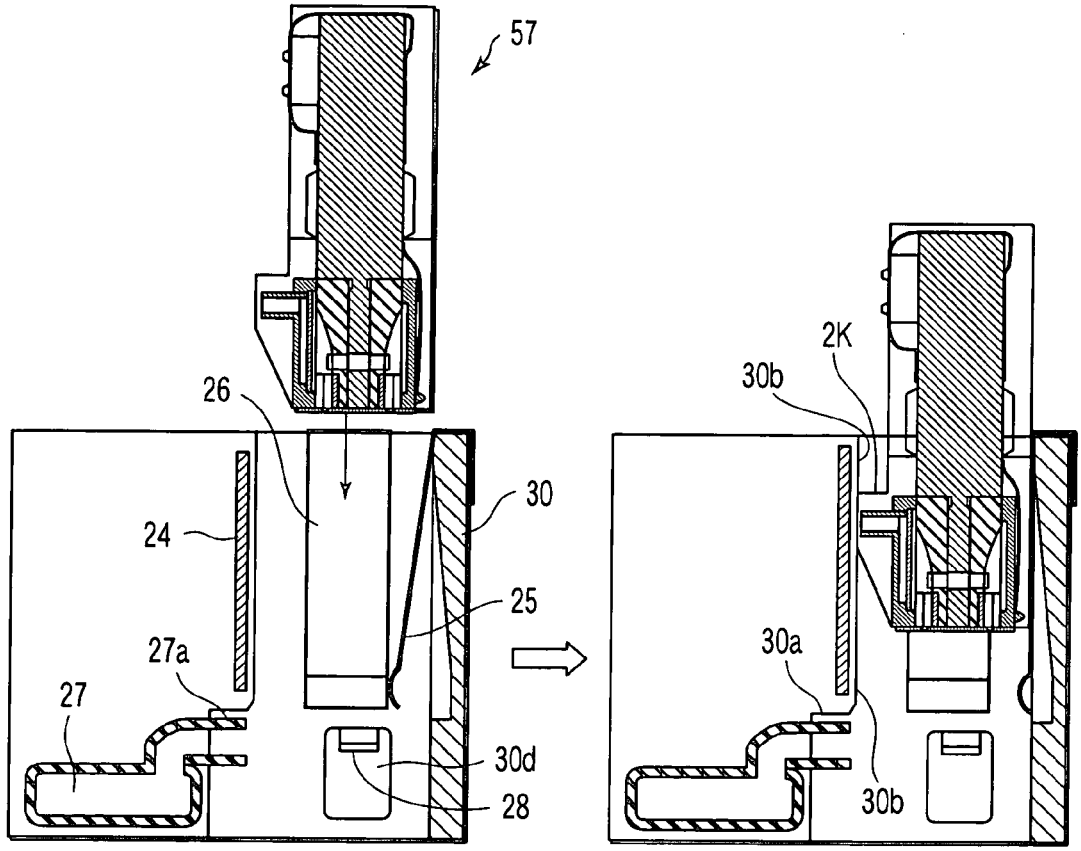
FIG. 16A
FIG. 16B
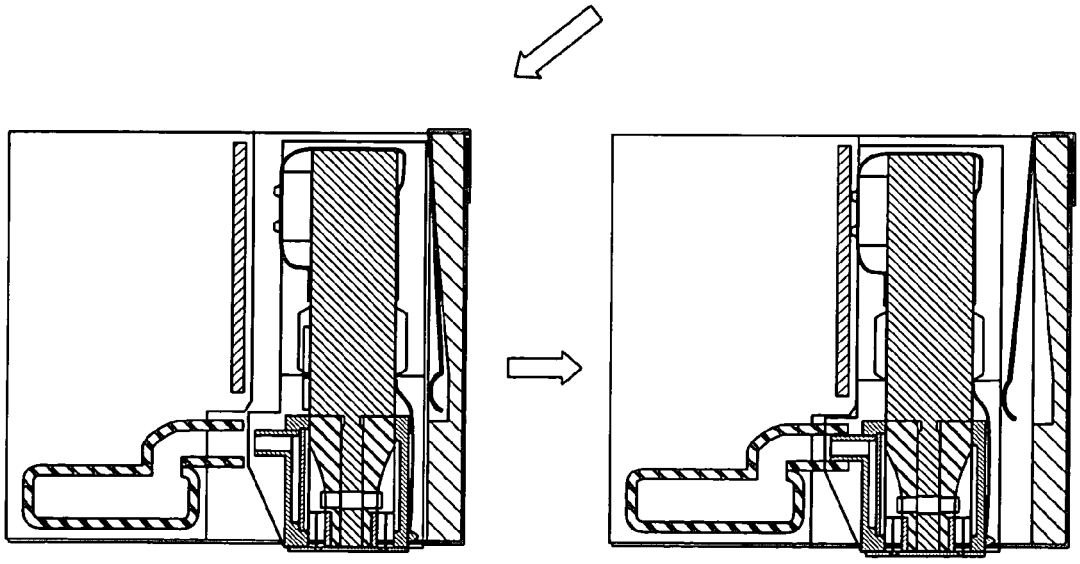
FIG. 16C
FIG. 16D

IMAGE FORMING APPARATUS INCLUDING LINE HEAD

CROSS-REFERENCE TO RELATED APPLICATIONS

This application is based upon and claims the benefit of priority from prior Japanese Patent Application No. 2005-024388, filed Jan. 31, 2005, the entire contents of which are incorporated herein by reference.

BACKGROUND OF THE INVENTION

1. Field of the Invention

The present invention relates to an image forming apparatus including a line head which realizes high-speed image formation.

2. Description of the Related Art

In general, there is a printer including a line head, in which a plurality of injection nozzles which eject inks of a black color or a plurality of colors are arranged in a linear state, thereby realizing high-speed image formation. In this line head, a plurality of injection nozzles are arranged face to face over a width of a recording medium to be carried so that an image can be formed along an overall width of the recording medium when the recording medium is transmitted only once. As the line head, there is also a type constituted of one long head which is a so-called line head, but such a head has a bad production yield and a problem of an increase in cost of the head.

As a countermeasure for such a problem, there has been proposed a technology which alternately aligns a plurality of small heads having a relatively low manufacturing cost in a width direction of a recording medium in such a manner that a gap is not generated between ends of these small heads, thereby virtually forming a line head. In Jpn. Pat. Appln. KOKAI Publication No. 2001-322292, small head chips are alternately aligned and arranged (a zigzag arrangement) in a direction orthogonal to a conveying direction of a recording medium and they are covered with a common nozzle plate, thereby constituting a line head. Since the short head chips are connected, a yield of each head chip is improved. Further, the head chips are covered with the common nozzle plate, there is an advantage that a positional accuracy between the respective chips can be determined by a nozzle hole position provided in the nozzle plate. However, when there is a nozzle which cannot eject an ink because of damage or the like caused due to clogging or jam of the nozzle after incorporation in an image forming apparatus, the entire line head must be replaced. Furthermore, the ink has a cartridge configuration which is thrown away together with the line head, and hence the head must be also replaced when the ink is run out. Moreover, Jpn. Pat. Appln. KOKAI Publication No. 2004-306261 discloses an example in which a plurality of heads are alternately aligned and arranged in a zigzag pattern along a direction orthogonal to a conveying direction of a recording medium instead of a line head having a length equal to or larger than a width of the recording medium.

In the above-described image forming apparatus disclosed in Jpn. Pat. Appln. KOKAI Publication No. 2001-322292, the line head is a module having an integral configuration, and the entire line head must be replaced when there is a nozzle which cannot eject an ink because of damage or the like caused due to clogging or jam of the nozzle after incorporation in a printer. Additionally, the ink has the cartridge configuration which is thrown away together with the line head, and hence the head must be also replaced when the ink is run out.

Further, Jpn. Pat. Appln. KOKAI Publication No. 2004-306261 discloses a configuration in which the individual heads are arranged in a zigzag pattern and there are many tubes which supply an ink to the individual heads or control wiring lines which supply an electrical signal, which results in complicated attachment/detachment or adjustment of each head. This publication does not disclose this attachment/detachment or adjustment at all. Furthermore, an ink supply path through which the ink is supplied to a eject opening formed in each head block is not illustrated, and its suggestion is not described either.

BRIEF SUMMARY OF THE INVENTION

According to the present invention, there is provided an image forming apparatus including a recording head portion having a configuration in which a plurality of small heads are alternately arranged in a width direction of a recording medium to have an overlap at each end portion thereof so that a virtual long line head is constituted, and each head can be individually replaced by easy attachment/detachment.

According to the present invention, there is provided an image forming apparatus which has at least one head module group in which a plurality of inkjet type head modules are arranged in a direction substantially orthogonal to a recording medium conveying direction, and has an ink path through which an ink is supplied to the head modules, thereby recording an image on the recording medium, wherein the ink path supplies the ink to the plurality of arranged head modules from one of an upstream side and a downstream side of the recording medium conveying direction.

Furthermore, according to the present invention, there is provided an image forming apparatus which has at least one head module group in which ink head type head modules are arranged in a direction substantially orthogonal to a recording medium conveying direction, and has an ink path through which an ink is supplied to the head modules, thereby forming an image on the recording medium, wherein a part of the common ink path through which the ink is supplied to all the head modules constituting the at least one head module group on one of an upstream side and a downstream side of the recording medium conveying direction is arranged in parallel with the head module group.

BRIEF DESCRIPTION OF THE SEVERAL VIEWS OF THE DRAWINGS

FIGS. 16A, 16B, 16C and 16D are views illustrating a process of attaching the head module to the recording head portion in the image forming apparatus;

DETAILED DESCRIPTION OF THE INVENTION

Embodiments according to the present invention will now be described hereinafter in detail with reference to the accompanying drawings.

FIGS. 1 to 4 show an appearance configuration of a recording head portion mounted in an image forming apparatus according to a first embodiment of the present invention.

Figure 1:
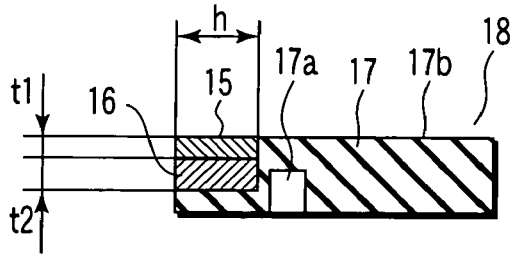
FIG. 1 is a view showing an example of a piezo structure of a recording head portion mounted in an image forming apparatus according to a first embodiment of the present invention.
Figure 2:
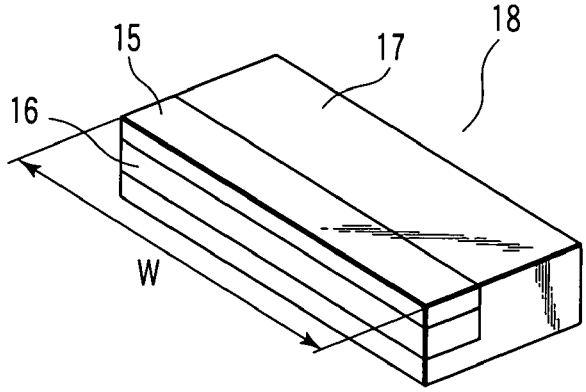
FIG. 2 is a view showing an appearance of the piezo structure of the recording head portion mounted in the image forming apparatus according to the first embodiment from an obliquely upward direction.

First, FIG. 1 shows an example of a piezo structure of a part which ejects an ink. This structure is obtained by attaching two piezo plates 15 and 16 having the same characteristics but different polarizing directions. These piezo plates 15 and 16 have the same length, and a length with a width W=approximately 60 mm is assumed so that approximately 300 eject nozzles can be arranged at intervals of 150 dpi in this example. Further, in regard to a thickness, the piezo plate 15 has a thickness t1=150 μm and the piezo plate 16 has a thickness t2=300 μm. A combined thickness is approximately 450 μm, and a length h in a short side direction is approximately 3.5 mm. The attached piezo plates 15 and 16 are bonded to a piezo plate 17 having different characteristics, thereby constituting such a piezo structure 18 as shown in FIG. 2. In the piezo structure 18, a notch is provided to the piezo plate 17 in advance in such a manner that a rectangular parallelepiped shape can be formed without a protruding part after bonding the piezo plates 15 and 16 to the piezo plate 17. This piezo structure 18 has, e.g., a width 60 mm, a thickness of 1 mm and a short side of 14 mm.

The piezo plates 15 and 16 and the piezo plate 17 have substantially equal degrees of hardness and are made of piezo-electric materials having different electrostatic capacities and piezoelectric constants. In this example, the piezo plates 15 and 16 are set to have a larger piezoelectric constant and electrostatic capacity than the piezo plate 17.

A configuration of a base 2 will now be described with reference to FIGS. 3 and 4.

Figure 3:
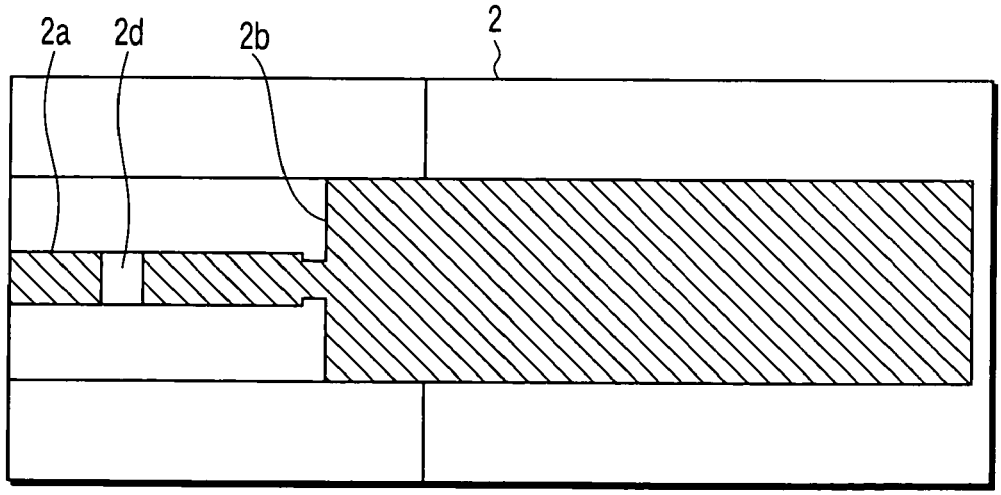
FIG. 3 is a view showing a cross-sectional configuration of a base to set up the piezo structure.
Figure 4:
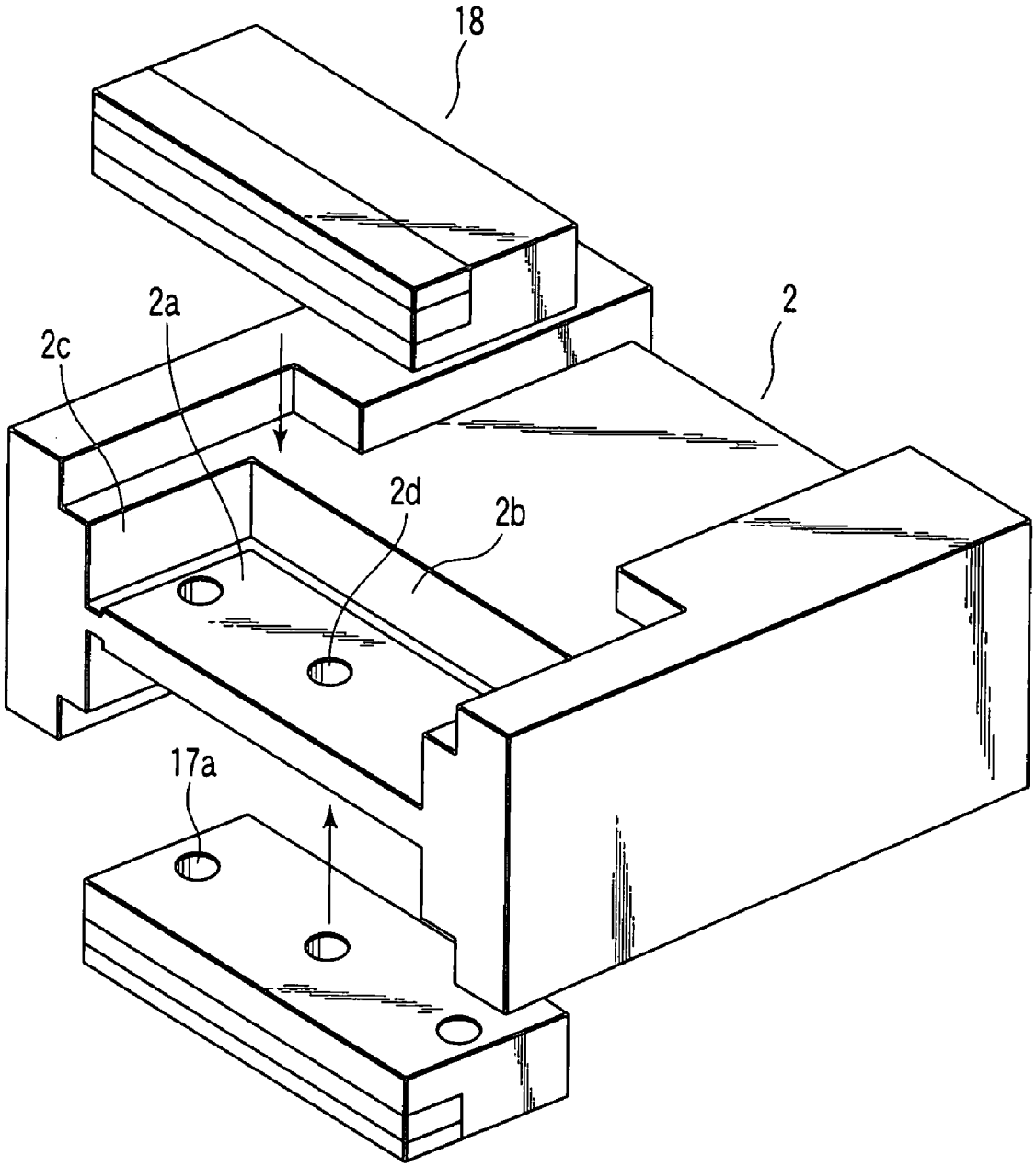
FIG. 4 is a view showing an appearance configuration of a base to which the piezo structure is to be attached from an obliquely upward direction.

FIG. 4 shows an appearance configuration of the base 2 from an obliquely upward direction, and FIG. 3 shows a cross-sectional configuration of the base 2. This base 2 consists of aluminum nitride or the like, and formed to symmetrically have low surfaces on front and back sides at a central portion of a substantially rectangular parallelepiped shape. A bonding reference portion 2*a* is formed in parallel with a plane of the outer shape by drilling. Since the base 2 is drilled down from both sides, a thickness of the bonding reference portion 2*a* is approximately 1 mm. A drilled-down portion surrounded by three bonding reference portions 2*a*, 2*b* and 2*c* has substantially the same shape as the piezo structure 18 so that the piezo structure 18 is fitted in this portion.

The piezo structure 18 is attached on both surfaces with the piezo plate 15 side being determined as an outer side while being pressed against the respective bonding reference portions 2*c* and 2*b*. A plurality of holes 2*d* through which the piezo structure 18 attached on both sides are connected and an ink is supplied are formed in a bottom surface of the bonding reference portion 2*a*. Furthermore, each hole with a bottom 17*a* is provided to the piezo plate 17 of the piezo structure 18 in such a manner that a position of the hole 17*a* matches with the hole 2*d*. A depth of the hole with a bottom 17*a* is formed in such a manner that it does not deeply pierces beyond at least the surface of the piezo 16.

Figure 5:
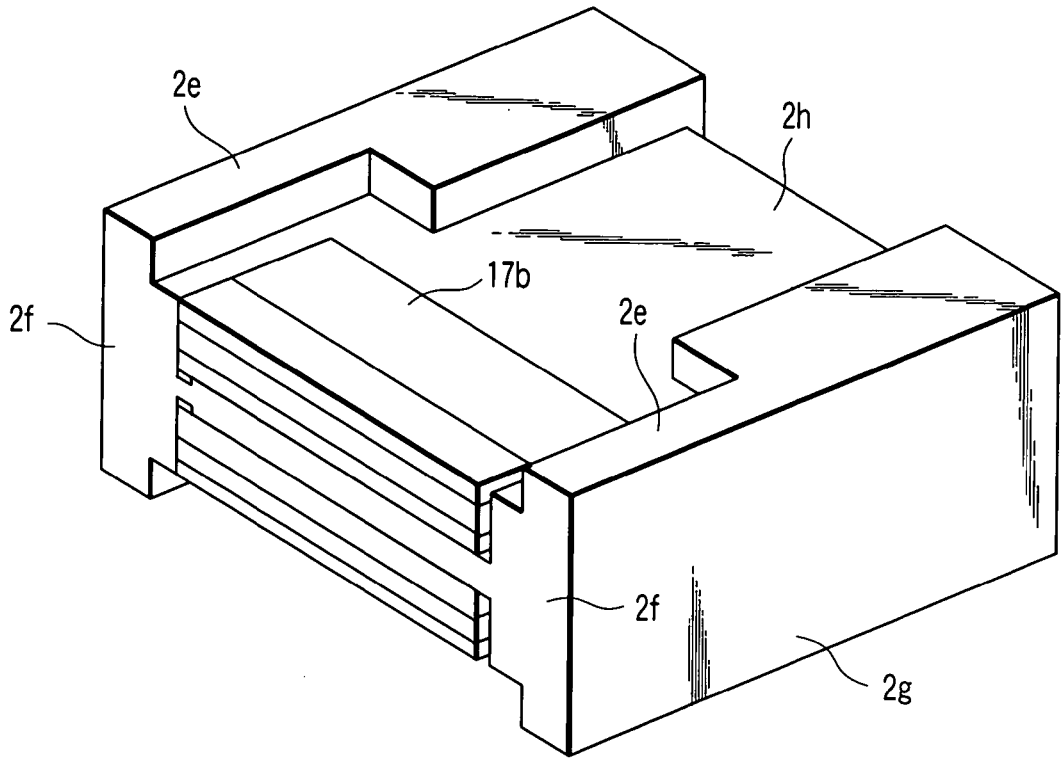
FIG. 5 is a view showing an appearance configuration of the base having the piezo structure attached thereto from the obliquely upward direction.
Figure 6:
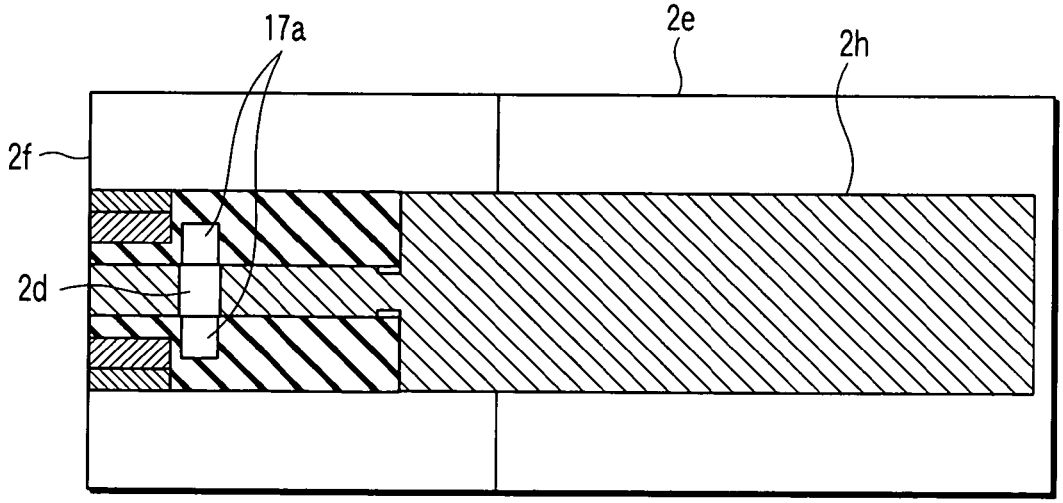
FIG. 6 is a view showing a cross-sectional configuration of the base having the piezo structure depicted in FIG. 5 attached thereto.

FIG. 5 shows an appearance configuration of the base 2 to which the piezo structures 18 are attached from both sides, and FIG. 6 shows its a cross-sectional configuration. When the piezo structures 18 are attached, an upper surface 17*b* of the piezo plate 17 and a surface of a central portion 2*h* of the base 2 are configured to form the same plane without a step. Further, the piezo structures 18 attached on both the surfaces of the base 2 are parallel with each other and also with an outer periphery of the base 2.

Figure 7:
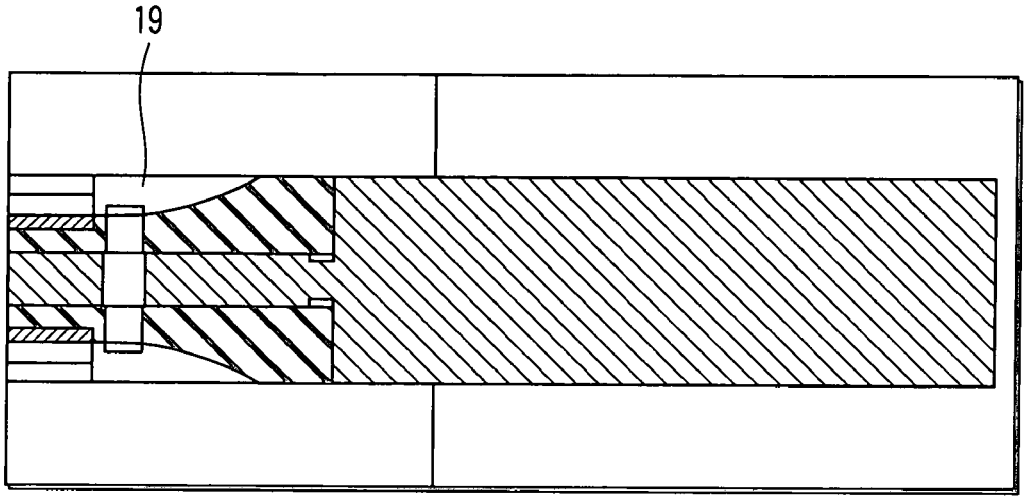
FIG. 7 is a view showing a cross-sectional configuration of the base in which grooves are formed in the piezo structure.
Figure 8:
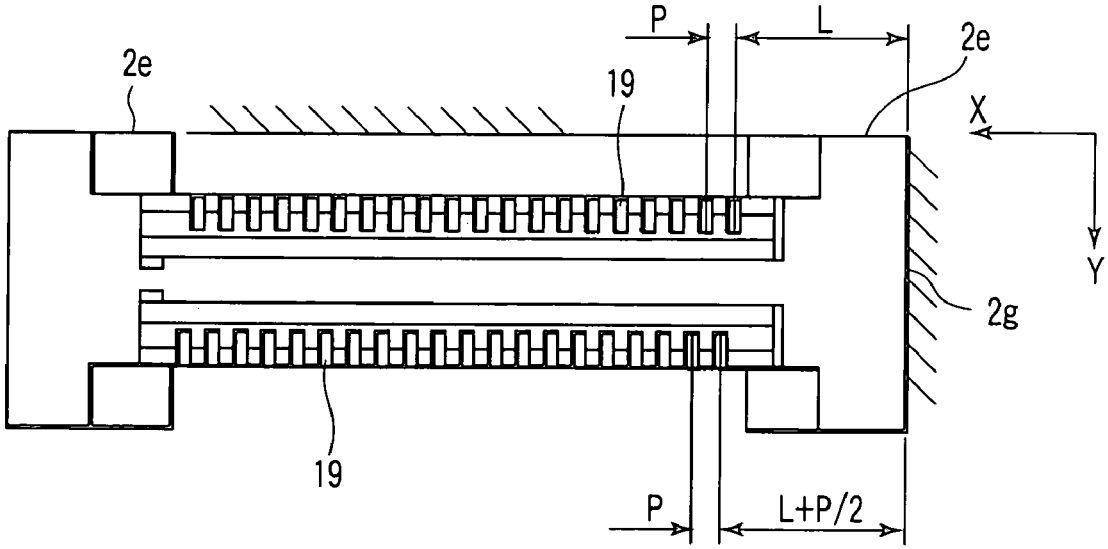
FIG. 8 is a view showing a groove cross section of the base in which grooves are formed in the piezo structure, as seen from a front side thereof.
Figure 9:
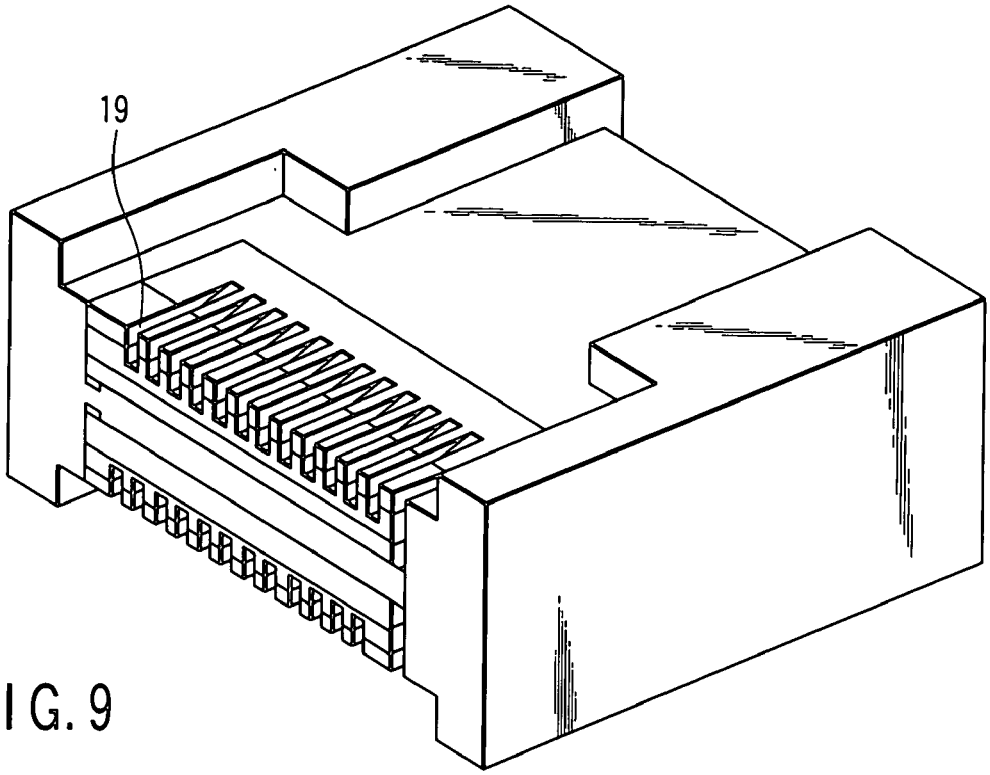
FIG. 9 is a view showing an appearance configuration of the base in which grooves are formed in the piezo structure, as seen from an obliquely upward side.

FIGS. 7 and 8 show a structural example of the base 2 to which the piezo structures 18 each having a plurality of grooves formed therein are provided. Here, FIG. 9 is a perspective view showing an appearance configuration of the base 2 having the plurality of grooves formed therein from an obliquely upward direction, FIG. 7 is a view showing a cross-sectional configuration along the grooves, and FIG. 8 is a view showing a groove cross section of the base 2 having the grooves formed therein from a front side.

In this piezo structure 18, such grooves 19 as shown in FIG. 7 which eject an ink are formed by cutting using, e.g., a diamond cutter. A reference of cutting is an XY reference surface (an X reference surface 2*g* and a Y reference surface 2*e*) of the base 2 show in FIG. 8. Before forming each groove, an electrode mask pattern before plating is formed with this XY reference surface being used as a reference. This electrode mask pattern is formed to extend from the central portion of the base 2 to the piezo 17. In this example, the mask pattern is generated at a part other than a plated portion which is formed by later-described plating processing.

Then, as shown in FIG. 8, in one of the piezo structures 18, the grooves 19 are formed at a pitch P with a position apart from the X reference surface 2*g* by a distance L in a direction X being determined as a starting point. In the other piezo structures 18, the grooves 19 are formed with a position apart from the X reference surface 2*g* by a distance L+P/2 being determined as a starting point. Since 150 dpi is set, each of these pitches P is approximately 169 μm. Since a shift length of the grooves 19 formed in these piezo structures 18 is approximately 84.5 μm because of P/2. A width of the groove 19 is approximately 80 μm, and a depth of the same is approximately 300 μm. A diameter of the diamond cutter used to form these grooves 19 is preferably approximately 20 mm, and a part of a bottom surface of each groove 19 has an arc-like shape as shown in FIG. 7. Some of the plurality of formed grooves 19 communicates with the holes 17*a*. According to this configuration, the piezo structures 18 attached on both surfaces through the holes 2*d* of the base 2 communicate with the holes 17*a* through the grooves 19.

Figure 10:
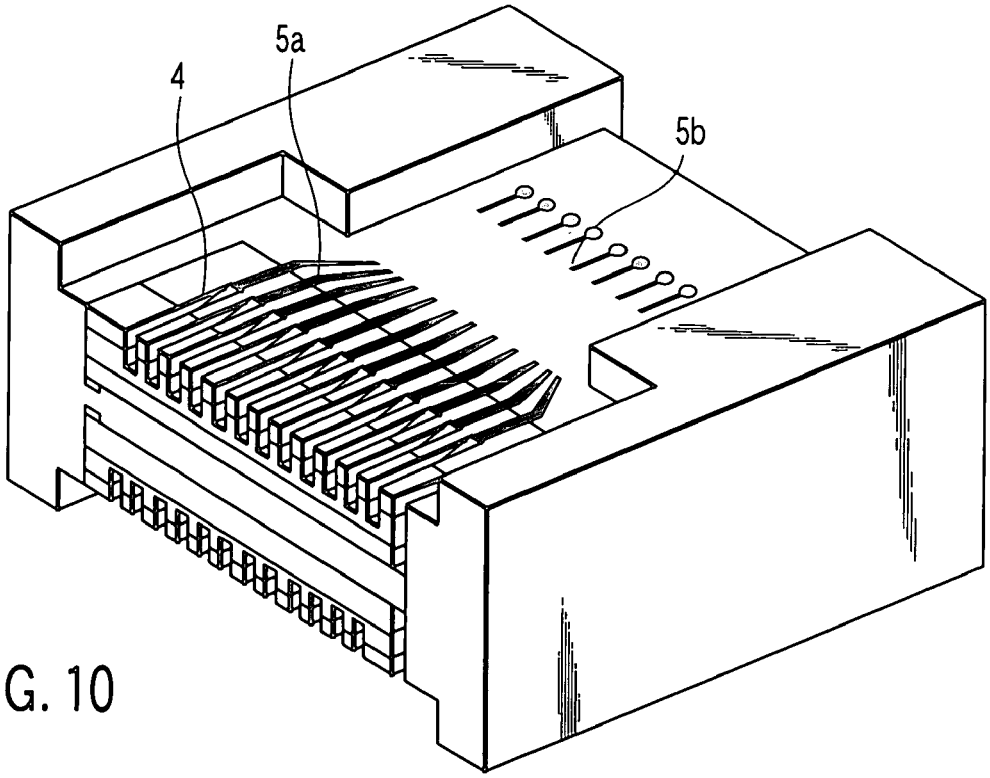
FIG. 10 is a view showing an appearance configuration of the base subjected to plating processing.
Figure 11:
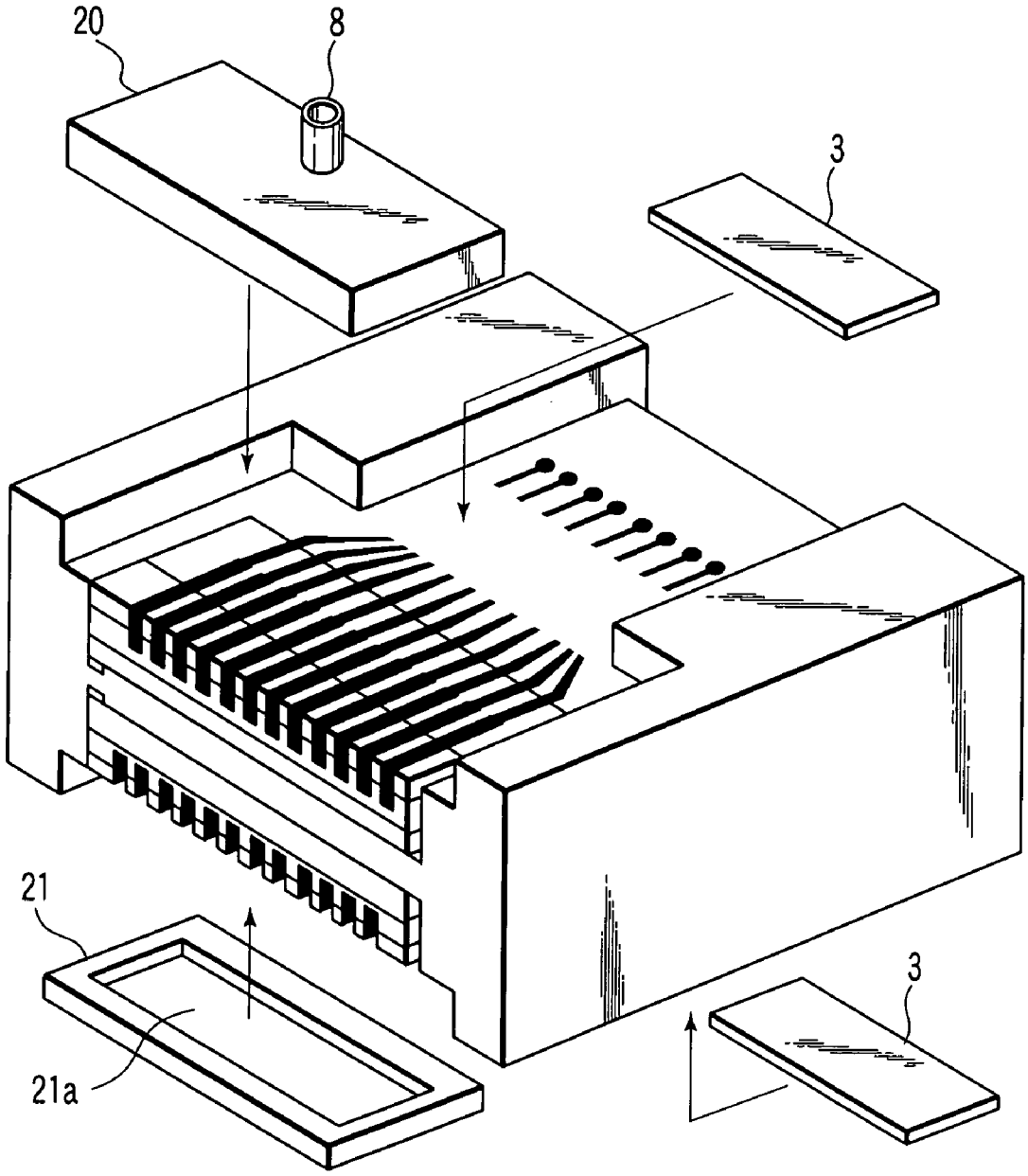
FIG. 11 is a view showing a cover which is attached to the base subjected to plating processing.

Next, FIGS. 10 and 11 show an appearance configuration of the base subjected to plating processing. A pattern is formed with respect to the base 2 having the above-described grooves 19 formed therein. That is, a pattern on an input side and an electrode pattern 4 electrically connected with each groove 19 on an outside are formed with a portion on which a drive IC 3 is mounted therebetween. Furthermore, an electrode is provided on an inner wall and a bottom portion of each groove cut by the diamond cutter. Therefore, each groove 19 has each independent electrode.

After forming these electrodes, as shown in FIG. 11, a cover 20 having an ink port 8 and a concave portion 20*a* which is provided at a central portion thereof and a cover 21 having a concave portion 21*a* at a central portion thereof are respectively bonded to the base 21 by using an adhesive. At this time, an amount of the adhesive is managed so that the adhesive does not run over the grooves 19.

Figure 13:
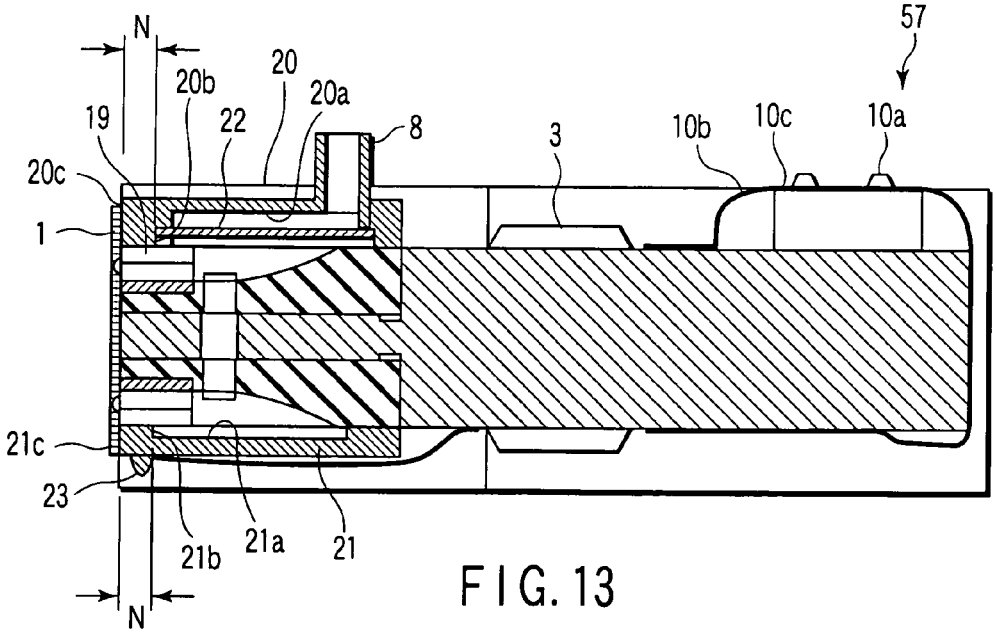
FIG. 13 is a view illustrating attachment of the nozzle plate to an open end portion of the grooves.

These covers 20 and 21 are positioned and bonded with respect to open ends 20*c* and 22*c* of each groove 16 as shown in FIG. 13. Moreover, a concave portion equivalent to that of the cover 21 is provided and a filter 22 is welded on a side of the cover 20 opposite to the ink port 8 (a bonded inner side).

Side surfaces 20*b* and 21*b* of the concave portions 20*a* of the covers 20 and 21 are set at positions apart from the groove open ends 20*c* and 21*c* to which a later-described nozzle plate 1 is bonded by N=approximately 1 mm. On the bottom surface of the groove 19, at least a part facing a flat surface portion where the concave portion of the cover is not formed is flat and cut in such a manner that a radius R is not formed by the diamond cutter. A range having a width of 80 μm, a depth of 300 μm and a length of 1 mm surrounded by each groove 19 and the covers 20 and 21 serves as a channel used as a drive portion to eject an ink.

Any other groove portion faces the concave portions 20*a* and 21*a* of the covers 20 and 21, and forms a larger space than the channel. This portion functions as a common ink chamber through which an ink is supplied to each channel. A depth of each concave portion 20*a* or 21*a* is approximately 0.5 mm. In case of the cover 20*a*, a distance to the filter 22 facing each groove 19 is a depth of 0.5 mm. A thickness of the cover 20 is 2 mm, and a thickness of the cover 21 is 1.5 mm.

Additionally, in this embodiment, a thermal expansion coefficient of PZT as a material of the piezo structure 18 is substantially equal to that of aluminum nitride as a material of the base 2. Aluminum nitride is hard and has stronger characteristics than PZT in terms of strength. When these different types of materials are attached, aluminum nitride reinforces strength of the piezo structures against an external force, and alleviates a stress of the fragile piezo structures due to a thermal expansion difference at the time of thermal expansion.

Further, the thermal expansion coefficients of these materials are substantial equal to each other. PZT has the thermal expansion coefficient of approximately $5\times10^{-6}$/° C., and aluminum nitride has the thermal expansion coefficient of approximately $3.5\times10^{-6}$/° C.

Such a difference results in a small thermal expansion difference of 2.7 μm with a temperature difference of 30° C. even in the piezo structure 18 having a length of 60 mm, which does not lead to a problem in operation. When a material having a thermal expansion coefficient which is not greater than at least $15\times10^{-6}$/° C. was adopted, damage to the piezo structure experientially did not occur with respect to a temperature change from −20° C. to +60° C.

Figure 12:
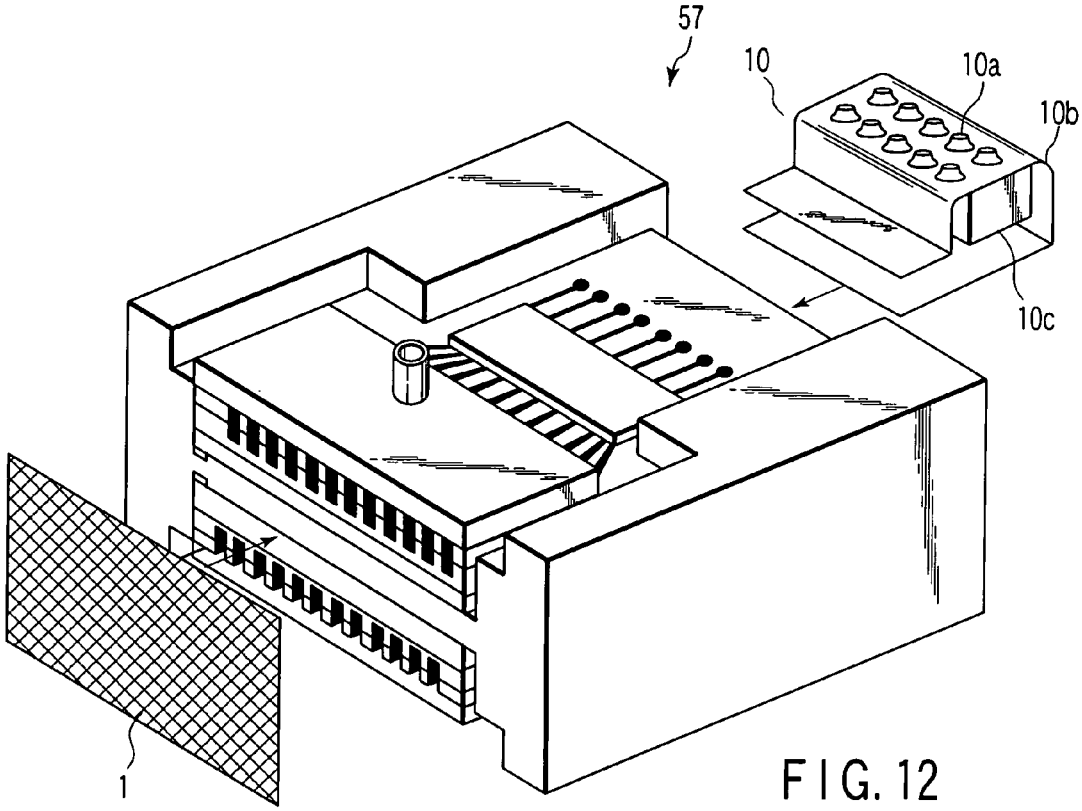
FIG. 12 is a view showing a nozzle plate and a power feed member attached to the base subjected to plating processing.

Then, as shown in FIGS. 12 and 13, a nozzle plate 1 is bonded to the open end portions of the grooves 19. The nozzle plate 1 is formed of, e.g., a polyimide film having a thickness of 50 μm. A power feed member 10 is provided at an end portion opposite to the nozzle plate 1. They are attached by using, e.g., an adhesive. The power feed member 10 has a shape obtained by bending a flexible cable 10*b*, and one end thereof is connected with the pattern 5*b* connected with the drive IC 3 on the front side whilst the other end thereof is connected with the drive IC 3 on the back side of the base 2. Protruding shape portions 10*a* machined to protrude toward the outside are formed on the pattern portion at a central portion of the power feed member 10.

These protruding portions 10*a* are provided with contact points to supply power or to supply a signal to a head module 57 from the image forming apparatus main body (a printer main body) side. A foamed elastic member is provided in the contact point and functions to press each emboss 10*a* of the power feed member 10 toward the image forming apparatus main body side by an elastic force.

Figure 14:
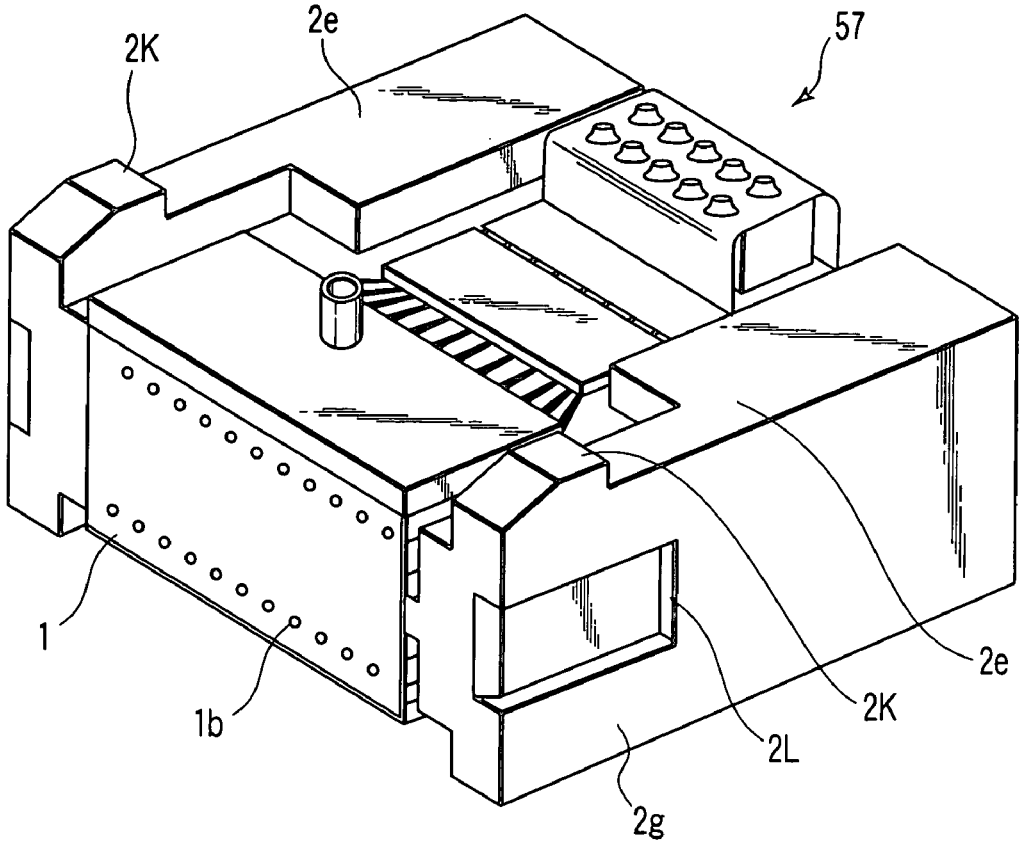
FIG. 14 is a view illustrating how to open nozzles in the nozzle plate.

Then, a plurality of nozzle holes from which an ink is ejected are formed with respect to the nozzle plate 1 by using laser machining. Each of these nozzle holes has a diameter which is approximately 25 μm. The nozzle plate 1 is set in a laser machining device with the outer shape reference surfaces 2*e* and 2*g* of the base 2 shown in FIG. 8 being determined as X and Y references. As shown in FIG. 14, nozzles 1*a* corresponding to the piezo structures 18 in two lines are formed by laser machining. Since a feed position accuracy of the laser machining device has a small error of approximately 1 μm, a position of each nozzle 1*a* which actually ejects an ink can be accurately machined from the references even if slight displacement is generated when forming each groove 19, for example. Further, since the two nozzle arrays are machined by a single attachment, spotting positions between the two lines can be accurately maintained even if a small angular error of attachment is generated.

According to the above-described manufacturing process, there can be configured a head module having 300 nozzles opened in one of the two lines, i.e., 600 nozzles opened in the two lines. A nozzle interval between these columns is 2.7 mm, and the nozzles are accurately provided in parallel at a pitch of 169 μm with a deviation of 84.5 μm. Furthermore, an ink supplied from the ink port 8 provided on the cover 20 is filled in the concave portion in the cover 20, foreign particles in the ink are filtered by a filter 22 to enter the common ink chamber, and the common ink chamber communicates with the grooves of the piezo structure 18 arranged on the opposite side through the holes 17*a* and 2*d*, thereby supplying the ink to each groove 19 provided in each of the piezo structures 18 on both sides.

Figure 15:
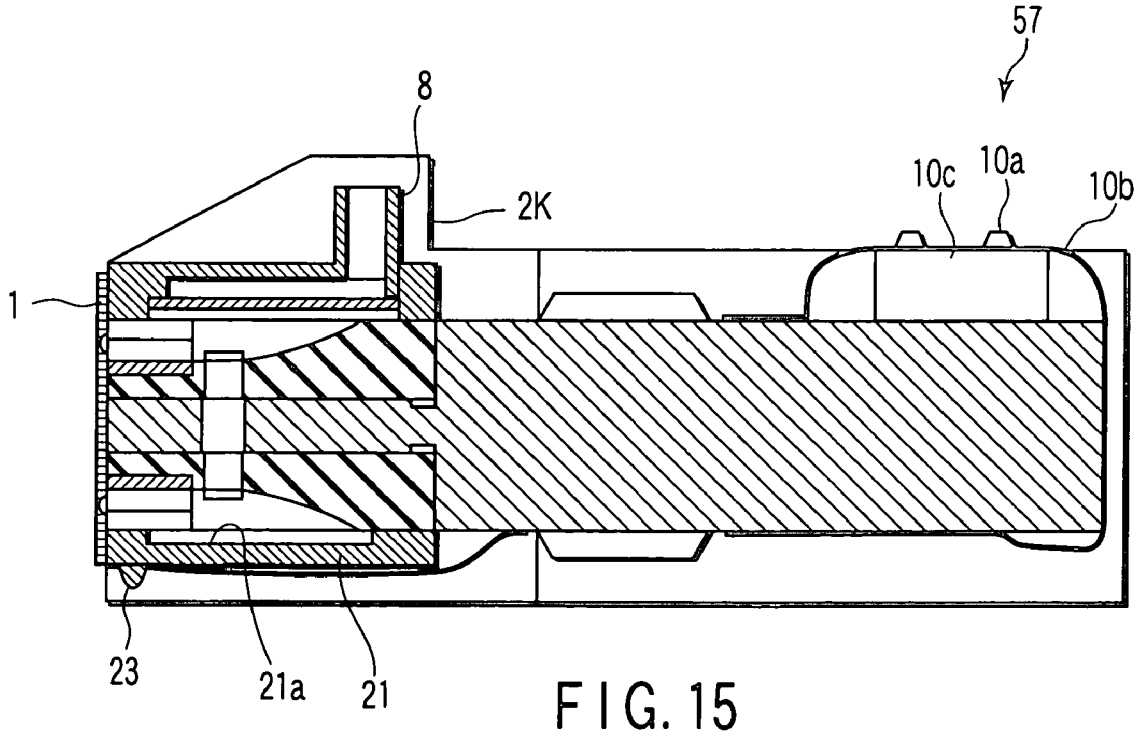
FIG. 15 is a view showing a cross-sectional configuration of a head module depicted in FIG. 14.

Moreover, such processing as shown in FIG. 14 is applied to the base 2 of the head module for attachment to a non-illustrated recording head portion of the image forming apparatus. Convex portions 2K and concave portions 2L are provided to the base 2. FIGS. 3 to 13 do not show the convex portions 2K and the concave portions 2L in order to illustrate other characteristic portions. A position at which each convex portion 2K is formed is set in such a manner that the convex portion 2K is higher than the ink port 8 as shown in FIG. 15. Therefore, an ingenuity is exercised to prevent a short circuit or contamination due to the ink which is caused by contact of the ink port 8 to which the ink has adhered with a later-described substrate 24 or the like when detaching the head module 57 from the apparatus.

A process of attaching the head module 57 to the recording head portion of the image forming apparatus will now be described with reference to FIGS. 16A, 16B, 16C and 16D. A head mount 30 is provided on a recording head portion side, and the head module 57 is attached in such a manner that it is dropped into a hole from an upper side. When the head module 57 is inserted into the hole from the nozzle plate 1 side, since springs 25 and 26 which press the head module 57 in the directions X and Y are provided on the inner surface side, the reference surfaces at the time of laser machining the head module 57 are pressed against reference surfaces 30*a*, 30*b* and 30*c* of the head mount 30.

Figure 17:
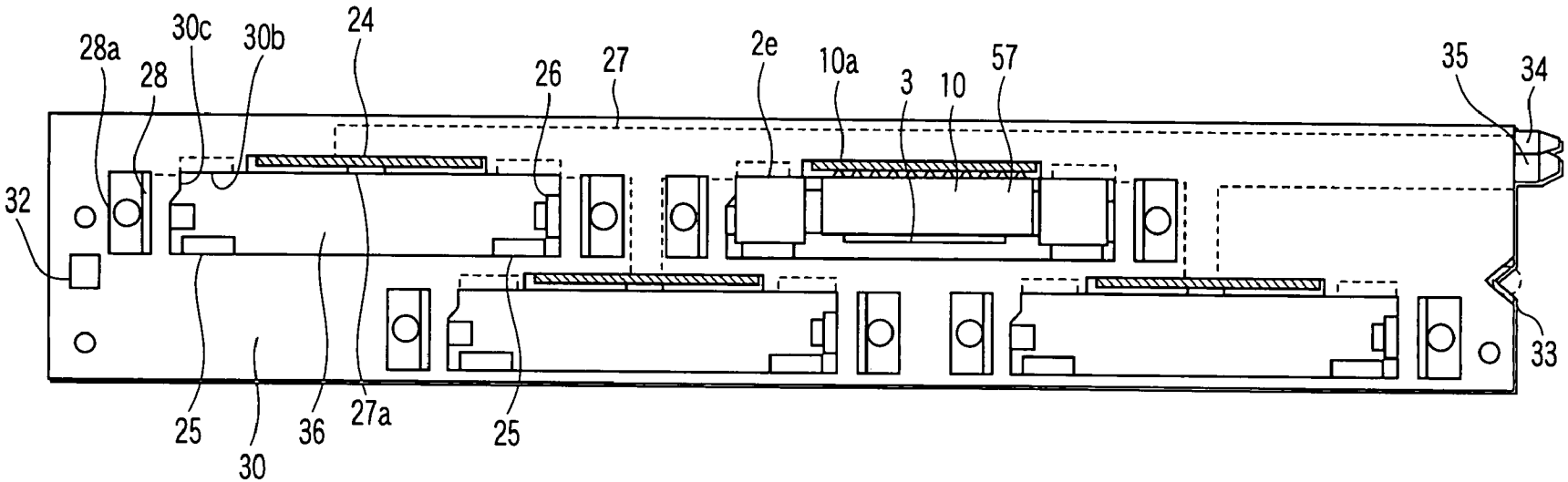
FIG. 17 is a view showing head insertion openings of a head mount in which the modules are attached from a front side.
Figure 18:
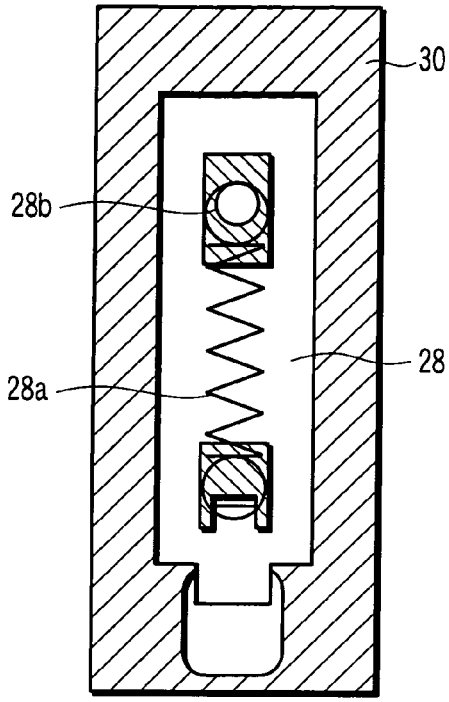
FIG. 18 is a view showing a structural example of a lever provided on a side surface of the head mount.

FIG. 17 is a view showing from a front side head insertion openings of the head mount 30 from which each module is attached. In FIG. 18, one end of a lever 28 provided on the side surface of the head mount 30 protrudes toward a head module insertion space (an insertion opening) 36 from a hole 30*d* and fits in a 2L portion of the head module 57. Of the four insertion openings 36 shown in FIG. 17, the insertion opening arranged at an upper right position has the head module 57 inserted therein. When the head module 57 is manually pressed down against a spring 28*a*, a base protruding portion 2K comes off a guide rib 30*b* of the head mount 30 and comes into contact with a spring 25 while being pressed by an elastic force of the spring 25 until the guide rib 30*b* is brought into contact with the base portion 2*e* by the spring 25. In this manner, the head module 57 is positioned in the direction Y. Further, the base portion (a reference surface) 2*g* comes into contact with a head mount hole 30*c* by the spring 26, so that the head module 57 is positioned in the direction X. When a hand is released, the head module 57 is moved in an upward direction in the drawing, and the protruding portion 2K comes into contact with the guide rib 30*a* so that the head module 57 is positioned in a height direction Z. In the inserted head module 57, each emboss 10*a* of the power feed member 10 is brought into contact with the electrode of the substrate 24, whereby power and a signal are supplied to the head module 57.

In the head mount 30, an ink path portion 27 is provided at a position apart from the head module inserting direction, on the upstream side of the recording medium conveying direction, and below an insertion opening. This ink path portion 27 is connected with a joint member 35 from an ink bottle 50 through a reservoir 51 shown in FIG. 19. An ink joint 27*a* is arranged at an uppermost portion of the ink path portion 27, and the ink port 8 is fitted in the ink joint 27*a* when the base portion 2*e* of the manually inserted head module 57 is pressed against the head mount 30*a*. Arranging the ink joint 27*a* at the uppermost portion can prevent the ink from sweeping down from the ink joint portion at the time of attachment/detachment and provides a function of allowing bubbles introduced by attachment/detachment to escape toward the upper side.

The ink joint 27*a* is formed of an elastic member such as a rubber. When the ink joint 27*a* is coupled with the ink port 8, it can supply the ink to the head module without leakage.

Figure 19:
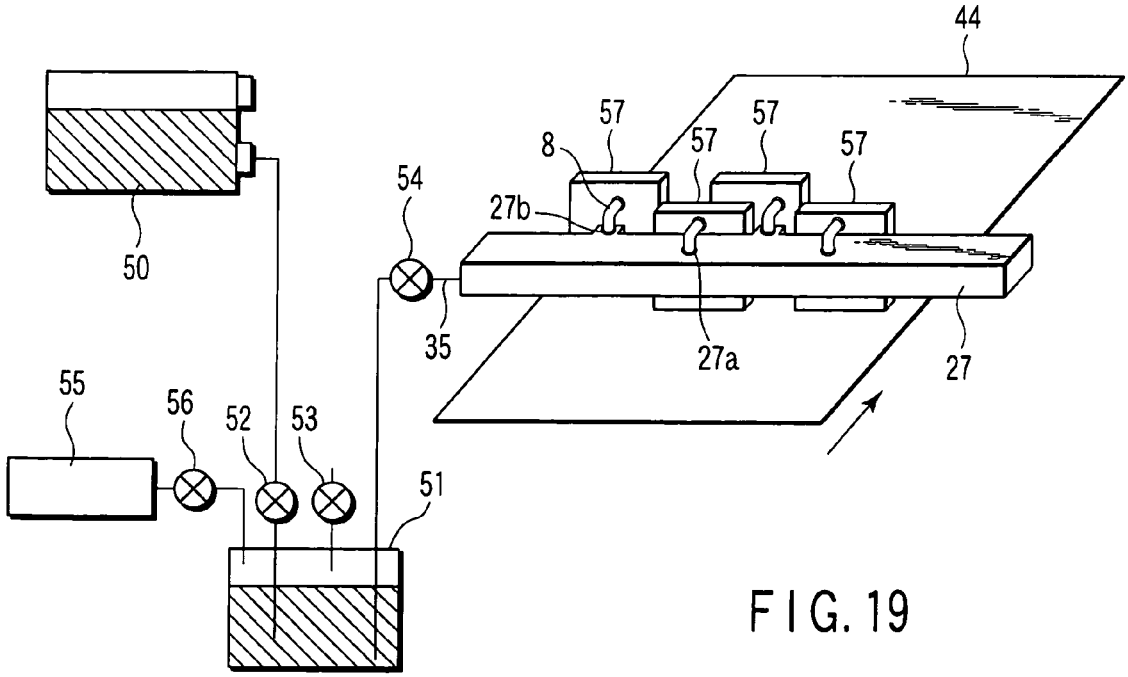
FIG. 19 is a conceptual view illustrating supply of an ink for image formation.

As shown in FIGS. 17 and 19, the two head module arrays each having the two head modules 57 which are substantially vertical to the conveying direction of the recording medium 44 and parallel with the width direction of the recording medium 44 and one head mount 30 having one ink path portion 27 which is an ink path through which the ink is supplied to these head module arrays constitute one head module group. The ink path portion 27 is a common ink path through which the ink is supplied to the four head modules 57 included in one head module group, and is positioned on the upstream side alone of the conveying direction of the recording medium 44 with respect to the four head modules 57 as shown in FIG. 19. The ink bottle 50 is provided at the uppermost position in the height direction, and the ink is supplied to the reservoir 51 by opening/closing of an ink supply electromagnetic valve 52 as needed. A non-illustrated liquid level detection sensor is provided to the reservoir 51, and controls an ink liquid level height in the reservoir to be constant. At this time, the liquid level height is placed at a position which is approximately 10 cm lower than the surface of the nozzle plate 1 of the head module 57. The inside of the reservoir 51 is usually opened to atmospheric air by an atmospheric air opening electromagnetic valve 53. An ink flow path is coupled with the ink path portion 27 from the reservoir 51 through a tube. The ink path portion 27 is arranged above the surface of the nozzle plate 1 of the head. A supply path valve 54 is provided between the reservoir 51 and the ink path portion 27. It is to be noted that an ink supply path from the reservoir 51 to the ink path portion 27 is not included in the ink path according to this embodiment. Furthermore, a pressurization pump 55 which supplies compressed air to the reservoir 51 is coupled with the reservoir 51 with a pressurization valve 56 provided along the way. When filling the ink in the head module 57, this pressurization pump 55 fastens a valve 54 to increase a pressure of the reservoir 51, and then opens the valve 54 to fill the ink at once. Moreover, when removing the head module 57, the pressurization pump 55 fastens the valve 54 to prevent the ink from leaking. The ink joint 27*a* into which the ink port 8 is inserted is provided on the uppermost surface of the ink path portion 27. Additionally, in this embodiment, since the head modules 57 are arranged in two lines, they are divided into a line close to the ink path portion 27 and the other line far from the ink path portion 27. Therefore, each bulge portion 27*b* is provided so that the ink port 8 of the head module 57 in the line far from the ink path portion 27 can reach the ink joint 27*a*.

According to this configuration, a pressure of reservoir 51 can be increased when filling the ink into each head module 57, thereby assuredly filling the ink. Further, when replacing each head module 57, closing the valve 54 can prevent air from entering the ink flow path.

When the head module 57 is inserted, the base convex portion 2K comes off the rib 23*b* and the surface 2*e* of the base is positioned in contact with the rib 23*b* by the spring 25, the ink port 8 is fitted in and coupled with the ink joint 27*a*. At least the ink joint 27*a* is formed of an elastic member such as rubber, and hence the ink can be prevented from leaking by the elastic force of the ink joint 27*a* when the ink port 8 is fitted in the ink joint 27*a*.

The substrate 24 is provided to the head mount 30 above the ink path portion 27, and the power feed portion 10 of the head module 57 pushed by the spring 25 is pressed against the substrate 24 by this series of head attachment operation, whereby the power supply is connected with a signal line. The power feed portion 10 has an elastic member 10*c*, and bending this elastic member 10*c* by the force of the spring 25 allows each emboss 10*a* to strongly come into contact with the pattern of the substrate, thereby realizing power feeding and connection of the signal line.

A second embodiment according to the present invention will now be described.

Figure 20:
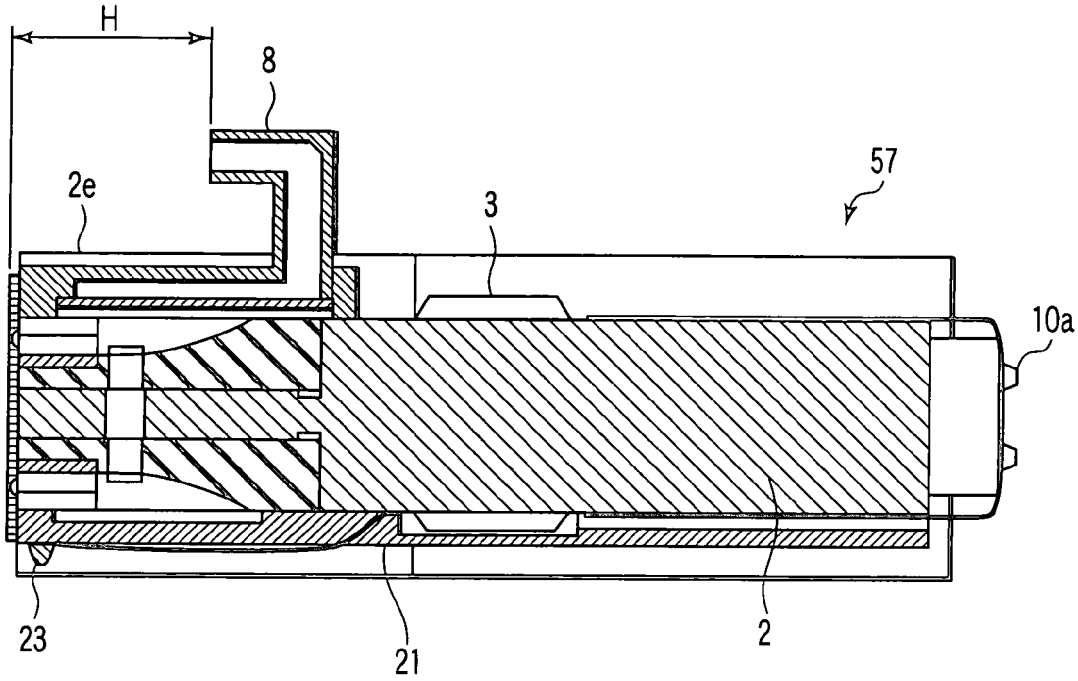
FIG. 20 is a view illustrating a different attachment conformation of a head module in a second embodiment.

FIG. 20 is a view showing an attachment method of a head module 57 according to a different conformation. This embodiment is different from the first embodiment in three points. The first point is that an ink port 8 is bent into an L shape along the way and its opening faces a nozzle plate 1 side. The second point is that a power feed portion 10 is provided on an end surface of a base 2 opposite to the nozzle plate 1. The third point is that a cover 21 covers a drive IC 3 and has a shape in which one end is extended to a position close to the power feed portion 10.

Figure 21:
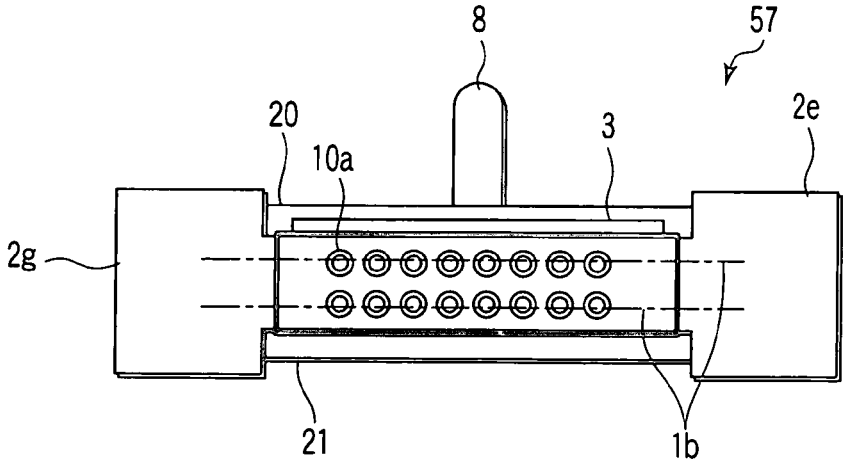
FIG. 21 is a view showing the head module in the second embodiment from a power feed portion side.

FIG. 21 is a view showing this head module 57 from the power feed portion 10 side. Two dashed lines 1*b* which are drawn at the center and parallel with each other indicate positions of nozzle arrays 1*b* provided on the nozzle plate 1 on the opposite side from which an ink can be injected.

In this module, a nozzle array interval is 2.7 mm, and a thickness of the ink port 8 except a protruding portion thereof is 6.5 mm. Each of both end portions of the base 2 is set higher than a central portion and has a thickness of approximately 8 mm. As described above, the nozzle arrays 1*b* are machined in parallel with a reference surface 2*e*. Furthermore, a positional accuracy from a reference surface 2*g* to nozzles in a direction X is set within ±5 μm.

FIGS. 22 to 26 are views showing a structural example of a head mount 30 with which a plurality of head modules 57 can be positioned in a recording medium width direction for attachment. This head mount 30 can hold the plurality of head modules 57 using an ink of one color. Holes 36 for attachment of the head modules 57 are formed at four positions in parallel in a zigzag pattern as seen from a head inserting direction. These holes are set at positions with which end portions of the adjacent head modules 57 overlap each other when the head modules 57 are attached as seen from a conveying direction of the recording medium. As will be described later, since nozzles are arranged without a gap in a direction orthogonal to a recording medium width direction when the head modules 57 are attached in the recording head position, and hence a straight line can be formed without a gap in the recording medium width direction by shifting an ink eject timing of the nozzle arrays.

Figure 23:
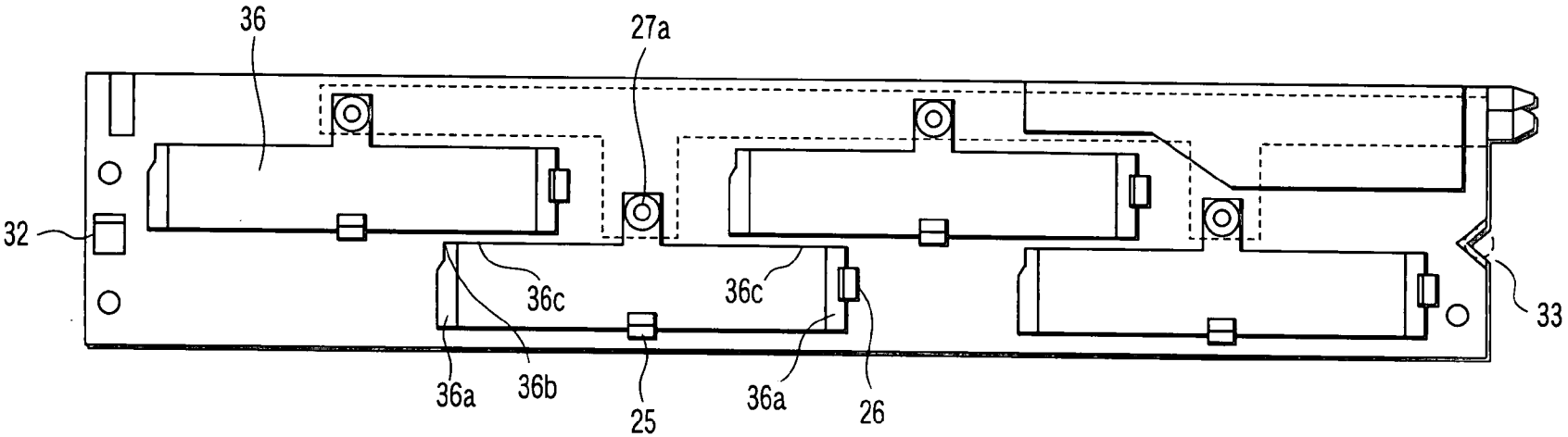
FIG. 23 is a view showing a structural example of the head mount before inserting the head modules.
Figure 25A:
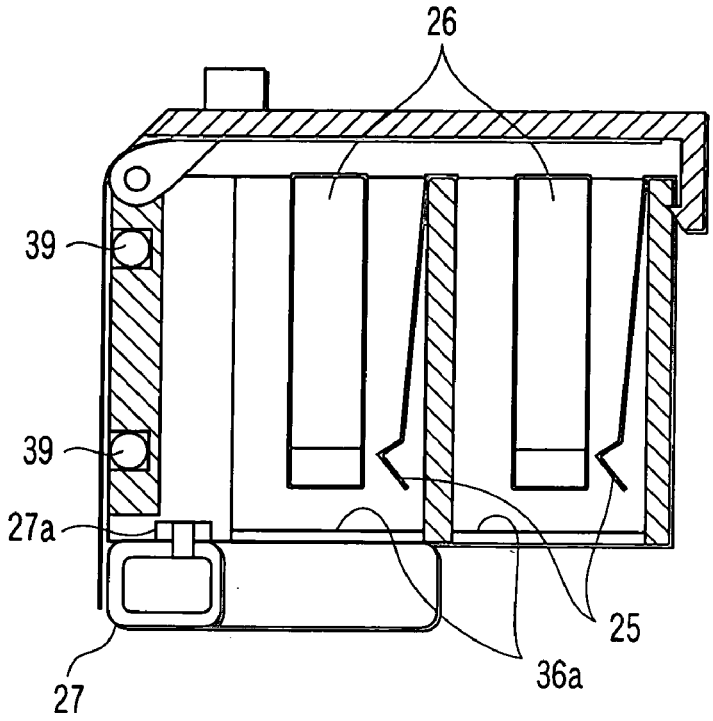
FIGS. 25A and 25B are views showing cross-sectional configurations in states where the head modules are not inserted into the head mount and where the head modules are inserted into the head mount.

FIG. 23 shows a state before inserting the head modules 57, and positioning in a direction Y is performed at a positioning portion 36*c*, positioning in a direction X is performed at a positioning portion 36*b*, and positioning in a direction Z as an ink injecting direction is performed at a positioning portion 36*a* (FIG. 25A). A spring 25 and a spring 26 protrude in the hole 36 and respectively function to push the head module 57 toward the positioning portion 36*c* and the positioning portion 36*b*. The hole 36 has a shape allowing an ink port 8 portion to be independent, and an ink joint 27*a* is provided at a lowermost portion thereof.

Figure 22:
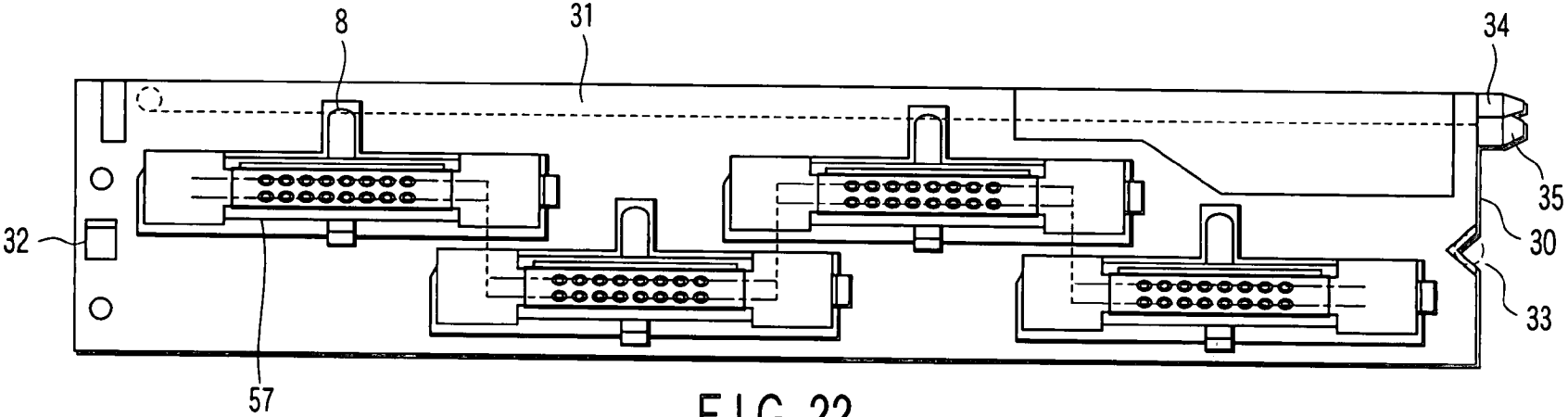
FIG. 22 is a view showing a structural example of a head mount in which a plurality of head modules are disposed and positioned in a recording medium width direction.

The head mount 30 is formed by die casting or of an extruded material, and its part requiring an accuracy alone is manufactured by cutting processing. For example, the positioning portions 36*a*, 36*b* and 36*c* used for positioning are simultaneously processed in each of the plurality of hole 36 portions, and they can be processed with an excellent positioning accuracy between these holes. FIG. 22 shows a state in which the head module 57 is inserted into each hole 36 of the head mount 30 subjected to cutting processing in this manner. The nozzle arrays are positioned in such a manner that they overlap the nozzle arrays of the adjacent head modules 57 in the recording medium conveying direction or that a dot pitch have an equal interval (84.5 μm) in the recording medium width direction. In other words, a contact positioning reference 36*b* of each hole 36 is accurately processed to have such an accuracy. On the head module 57 side, likewise, processing is performed in such a manner that the same dimension and accuracy from a base portion 2*g* to an end portion of a nozzle 1*a* can be provided.

Furthermore, accurate processing is carried out in such a manner that a line connecting the contact references 36*c* at both end portions in one hole 36 becomes parallel with all the holes 36*c*. The head module 57 is also processed in such a manner that the two head arrays become parallel with surfaces 2*e* at both end portions as contact target. Therefore, all the nozzle arrays 1*b* included in the plurality of head modules 57 inserted into the head mount and positioned become parallel. When the head modules 57 are arranged in a zigzag pattern in this manner, a distance between the adjacent heads in the recording medium conveying direction can be set as short as 11 mm.

Figure 25B:
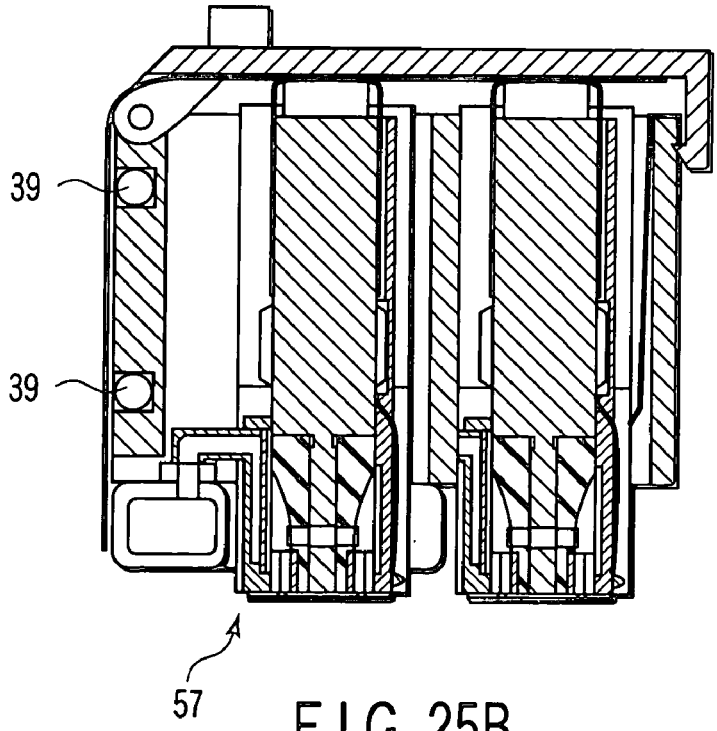

FIG. 25B shows a cross section in a state where the head modules 57 are inserted into the head mount 30. The ink path portion 27 is extended and arranged in the recording medium width direction at the lowermost portion of the head mount. An ink joint 27*a* is provided at a position corresponding to the ink port 8 on an uppermost surface of the ink path portion 27. The ink joint 27*a* is formed of rubber having elasticity, and each head module 57 can be coupled with the ink path portion without leakage of an ink when the ink port 8 is inserted into the ink joint 27*a*.

The ink path portion 27 is arranged on one of lines of the plurality of head modules arranged in the recording medium conveying direction. An ink joint member 35 which can be coupled with a printer main body is provided at an end portion of the ink path portion 27. An apparatus main body has an ink tube through which an ink is supplied to each head. When the ink tube is connected with this ink joint member 35, the ink can be supplied to all the head modules 57 from the ink joints 27*a* through the ink path portion 27.

A head drive substrate 38 is arranged on a longitudinal side wall of the head mount 30. Moreover, a lid 37 is arranged on an upper surface of the head mount 30 to cover an upper surface of each head module 57, and provided to be opened and closed with respect to the head mount 30 with a supporting point 37*a* at the center. Pluralities of hooks 37*b* are provided on the other end side of the supporting point. When the lid 37 is closed, the hooks 37*b* engage with non-illustrated concave portions of the head mount 30, thereby maintaining a closed state. The head drive substrate 38 is a flexible substrate, and a part of this substrate is extended toward and fixed at the inside of the lid 37.

In a state where the lid 37 is closed, an electrode of the head drive substrate 38 inside the lid 37 comes into contact with a power feed member 10, and each head module 57 is connected with the head drive substrate 38. As described above, an elastic fore of an elastic member 10*c* pushes each emboss 10*a* toward the head drive substrate 38, thereby maintaining normal contact. A contact portion 2*m* (FIG. 27) of each head module 57 is brought into contact with a positioning portion 36*a* in a direction Z with a reactive force of the elastic force.

Figure 24:
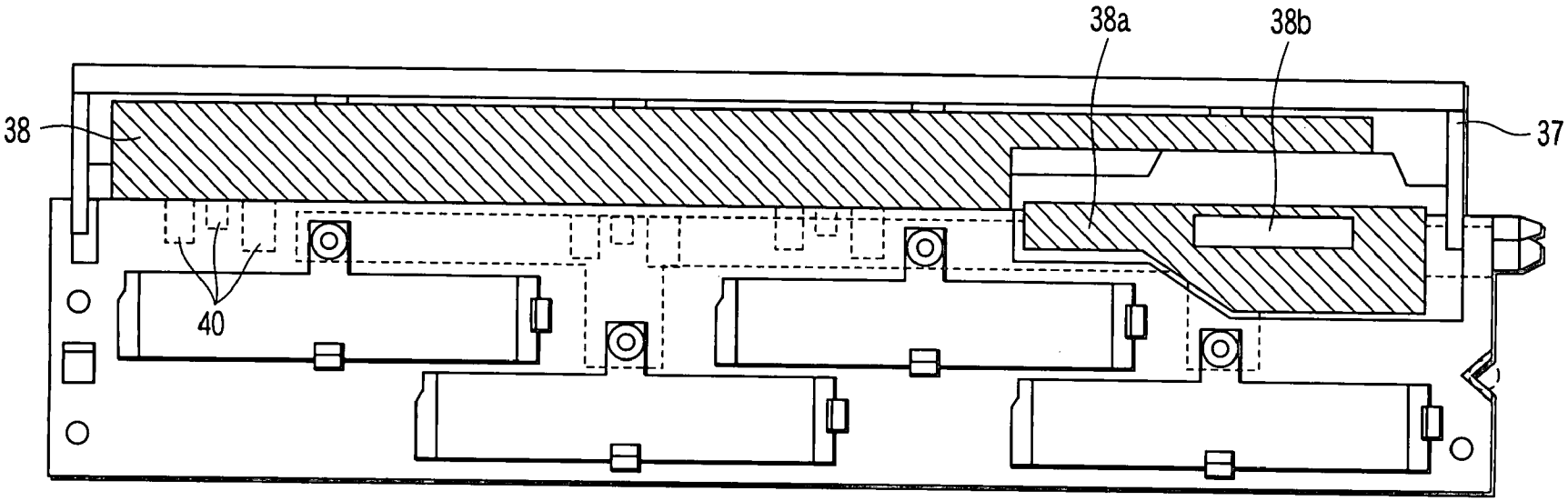
FIG. 24 is a view showing a structural example of the head mount having a lid and a head drive substrate attached thereto.

FIG. 24 is a view showing from above a state in which the lid 37 and the head drive substrate 38 are disposed. A part 38*a* alone of the head drive substrate 38 is attached and fixed on the upper surface of the head mount 30 rather than the lid 37. Since the heads are arranged in a zigzag pattern in this part, the lid 37 has a shape which does not cover the upper surface of the head mount 30 at the part where the head modules 57 are not arranged. That is, a connector 38*b* provided to the head drive substrate 38 is provided at the substrate 38*a* portion which is not covered by opening/closing of the lid 37. The connector 38*b* is a connection connector which supplies a signal and power from the printer main body to the head drive substrate 38 which drives all of the plurality of heads mounted in the head mount.

Figure 26B:
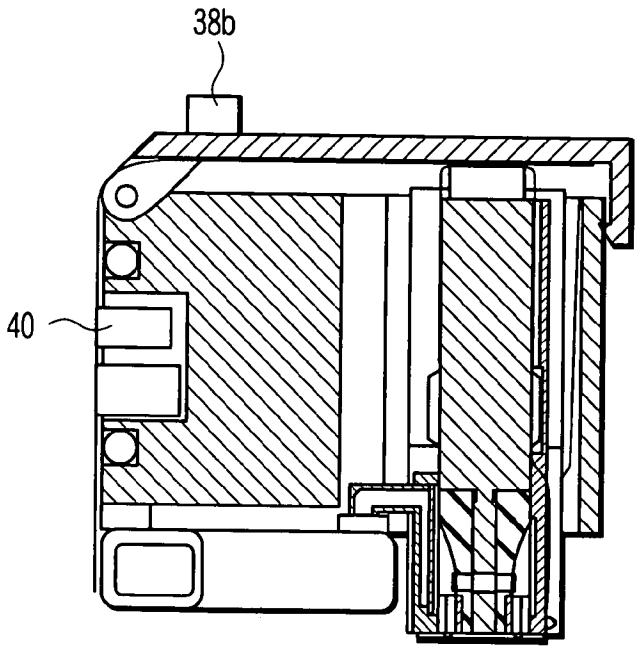
FIGS. 26A and 26B are views showing a connection a power feed portion with a head drive substrate by closing a lid in which the head modules are inserted.
Figure 26A:
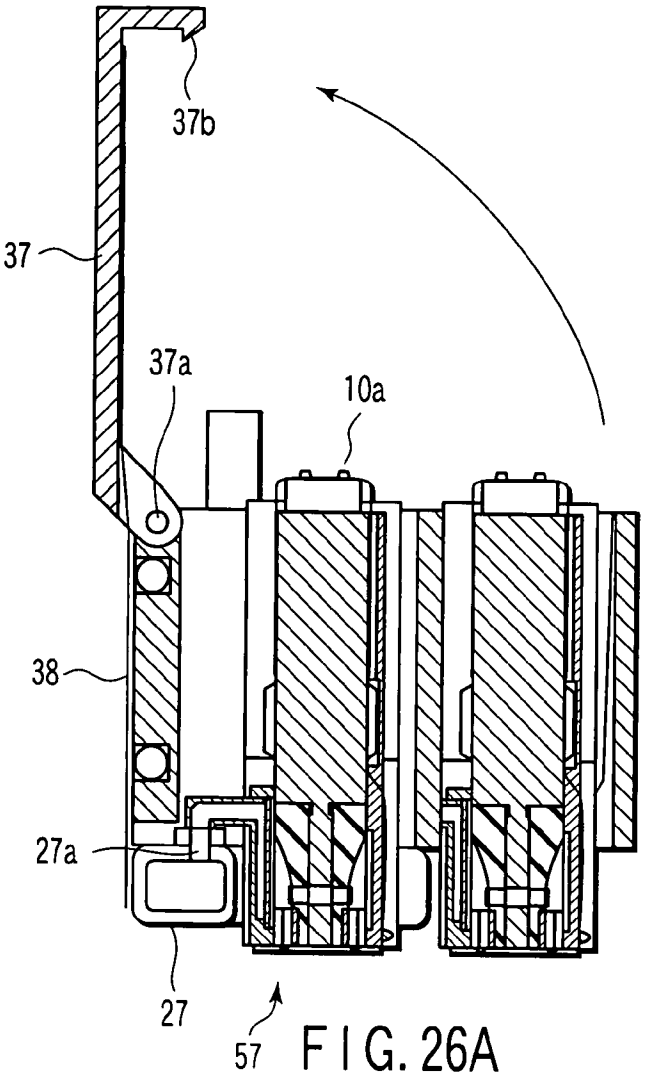

A degree of viscosity of the ink in the head ink modules changes depending on a temperature. In order to maintain a eject speed or a eject drop volume of the ink ejected from each head module 57 to appropriate values, a voltage optimized in accordance with a temperature in the vicinity of the nozzles 1*a* must be applied to each head module 57. As the power supplied to the substrate 38, power of, e.g., 36 volts is supplied to this connector 38*b*. In order to optimally control characteristics of injection of the ink from each head module 57, a temperature of each head module 57 is detected by a thermistor 23 (FIG. 20), and the head drive substrate 38 is used to produce a voltage appropriate to this temperature to be supplied. An element having a height of approximately 10 mm, e.g., a dropper which drops the supplied power of 36V to, e.g., 20 volts or a capacitor which stabilizes a power supply is mounted on the head drive substrate 38. FIG. 26B shows an element 40. Arranging the head mounts 30, whose number corresponds to the number of colors, in the recording medium conveying direction can cope with color printing. Therefore, when a dimension in the conveying direction is increased as described above, an inter-color distance is increased, which affects spotting displacement of each color with respect to oblique traveling of the recording medium. Therefore, arrangement of the element having a large height is important. In this embodiment, the element having a large height is arranged from the head drive substrate 38 toward the inside of the head mount 30 by utilizing a space generated between the alternately arranged head modules 57 of the head modules 57 arranged in the zigzag pattern in the recording medium width direction. In this manner, a distance between respective colors is set to a minimum value by arranging the high element 40 in a projection area of the head mount 30. Further, this element with a large height has a circuit which finely adjusts a voltage to be fed to each head mounted therein. Therefore, the element 40 can be arranged at a part where a distance between the respective head modules 57 is short, and hence there is a merit that a voltage hardly drops and the apparatus has resistance to noise.

Furthermore, joints 34 of a temperature control pipe are provided above and below the ink joint portion 35. Pure water subjected to temperature control is supplied/discharged from the joints at the two positions by the non-illustrated pump. The joints 34 are coupled with a pipe 39 embedded in the head mount 30. The pipe 39 is formed of a metal such as copper having excellent heat conduction properties, and in contract with the head mount 30 for heat radiation. Pure water flowing through the pipe is subjected to liquid temperature control by a non-illustrated temperature control device such as a chiller.

Usually, thermal conductivity of the piezo structure 18 is as low as 2 to 5 W/(mK), whereas the base 2 is characterized in thermal conductivity which is as high as 170 to 180 W/(mK) since the base 2 is formed of aluminum nitride. Both these members have substantially equal thermal expansion coefficients ($5\times10^{-6}$/° C.), and a crack or a distortion due to a change in temperature is rarely generated even if these members are attached to each other. Moreover, since aluminum nitride is provided with respect to the thin tabular piezo structure 18 in parallel, heat generated in the piezo structures 15, 16 is rapidly absorbed in the base 2 through the piezo structure 18. On the contrary, when the base 2 has a higher temperature, the piezo structure 18 is heated by the base 2.

Heat generated by the head module 57 is mainly heat produced due to deformation of a channel portion and heat generated due to driving of the drive IC 3. In particular, heat generated by the drive IC holds a majority. Heat generated in the channel is also taken by the ink which is driven and ejected, and a temperature is not greatly increased. Heat generated by the drive IC 3 is absorbed in the base 2 with excellent thermal conductivity since the drive IC 3 is directly attached on aluminum nitride. In general, it is said that an allowable temperature limit of the drive IC 3 is not greater than 100° C.

The surface 2*e* of the base 2 is pressed against the surface 36*c* and positioned in a state where the base 2 is attached to the head mount 30 and positioned. As a result, heat generated by the drive IC 3 is transmitted to the head mount 30 from this contact surface. As described above, since the pipe 39 is embedded in the head mount 30 and the temperature-controlled liquid is circulated, heat exchange is performed through the pipe 39. As this circulating liquid, temperature-controlled pure water is circulated in order to maintain the channel portion of the piezo structure 18 at a fixed temperature. For example, when the channel portion should be maintained at 50° C., a temperature of the circulating liquid is controlled in such a manner that the thermistor 23 provided to the head module 57 indicates a resistance value corresponding to 50° C. When a plurality of head modules 57 are provided, control is performed in such a manner that an average value of these heads becomes 50° C. The head modules 57 or the head mount 30 is at the same temperature as, e.g., 25° C. which is a room temperature immediately after the power supply is turned on. In this case, the head mount 30 is heated by the circulating water, the base 2 is heated through the head mount 30, and the piezo structures 18, 16, 15 are finally heated, thereby approximating a target temperature. On the contrary, when image formation is continuously carried out, heat is generated from the drive IC3 or the piezo structure 18. This generated heat is conversely cooled by the circulating water from the base 2 through the head mount 30.

As any other head generation source, there is the head drive substrate 38. Since the head drive substrate 38 is provided with a power supply, heat is likewise generated in this substrate. As described above, the element which generates a large quantity of heat is arranged in a part without the head module 57 of the plurality of head modules 57 alternately arranged in the head mount 30 or a space part excluding the ink port 8 in such a manner that it is embedded in the head mount 30. Actually, the element 40 and the head mount 30 are arranged in such a manner that a gap therebetween is filled with a filling material having excellent thermal conduction properties. Therefore, even if heat is generated from the element 40, it is absorbed in the head mount 30 through the filling material and cooled by the pipe 39 arranged in the vicinity of the element 40.

One head module group is constituted of one head mount 30 having the two head module arrays each having the two head modules 57 which are vertical to the conveying direction of the recording medium 44 and parallel with the width direction of the recording medium 44, the ink path portion 27 which is an ink path through which the ink is supplied to the head module arrays, the head drive substrate 38 and the temperature control pipe 39.

The head mount 30 is independently manufactured in accordance with each of a plurality of colors. In one head mount, a mutual positioning accuracy of the respective head modules 57 is assured by a nozzle position accuracy with respect to the base 2 of each head module 57 and an accuracy of the head mount 30.

Figure 28:
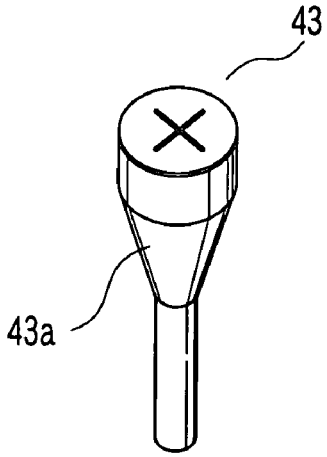
FIG. 28 is a view showing an appearance of an adjustment screw.
Figure 29:
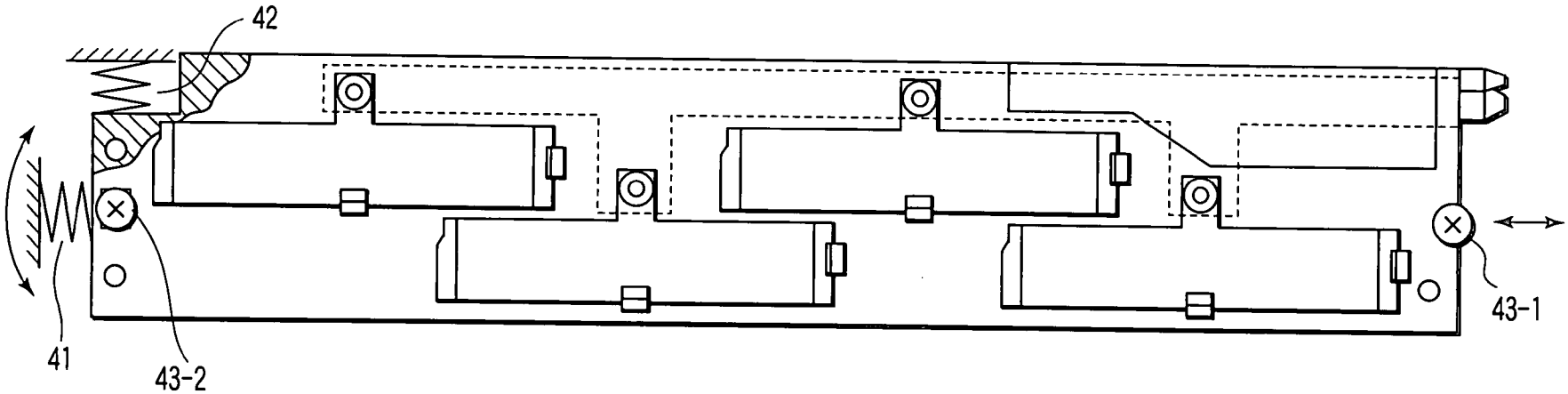
FIG. 29 is a view illustrating positional adjustment of the head mount.

However, since a position of each head mount 30 is not guaranteed, adjustment is required. For example, as shown in FIG. 29, adjustment portions are provided at both ends of the head mount 30 in the longitudinal direction. On end has a V-shaped inclined surface 33 in the V-shaped head mount 30 (FIG. 23). Such an adjustment screw 43-1 as shown in FIG. 28 is attached on the inclined surface 33. The V-shaped part of the inclined surface 33 with which the adjustment screw 43-1 comes into contact has a gradient of approximately five degrees. A tapered part 43-1*a* of five degrees is likewise provided to a body portion of the adjustment screw 43-1. When the adjustment screw 43-1 is rotated to move forward, the tapered part 43*a* in the body portion of the adjustment screw 43-1 pushes down the V-shaped inclined surface 33, and hence the entire head mount 30 moves toward the spring 41 side against the spring 41. On the contrary, when the adjustment screw 43 is rotated to be loosened, the tapered part 43-1*a* in the body portion of the adjustment screw 43 moves up, and hence the entire head mount 30 is pushed by the spring 41. The V-shaped portion comes into contact with the adjustment screw, and the head mount 30 moves away from the spring 41. This adjustment enables the head mount 30 to be moved and adjusted in the longitudinal direction.

Likewise, an adjustment screw 43-2 is also screwed in a hole 32, and an upper side of the hole has a tapered part of five degrees. The entire head mount is pushed by a spring 42 in such a manner that the tapered part of the hole and the adjustment screw 43-2 are pushed. When the adjustment screw 43-2 is likewise fastened or loosened, the head mount 30 can swivel around the adjustment screw 43-1 at the other end and the V-shaped portion, thereby enabling adjustment of an angle. A position of the head mount 30 in the longitudinal direction and an angle of the same around one end can be adjusted by the two adjustment screws 43-1, 43-2, and the head mount 30 can be fixed in the image forming apparatus (the recording head portion) main body.

A line connecting the adjustment screws 43-1 and 43-2 at both end portions is arranged at a position which is substantially parallel with the nozzle arrays 1*b* of the plurality of alternately arranged heads and runs through the center of the alternately arranged heads. This arrangement can efficiently adjust an angle with respect to a moving distance of the adjustment screw 43-2. Additionally, a concave portion is provided in the projection area of the head mount 30 and the spring 42 is configured to push this concave portion, and hence the spring 42 can be arranged without increasing the width in the short side direction.

Figure 30:
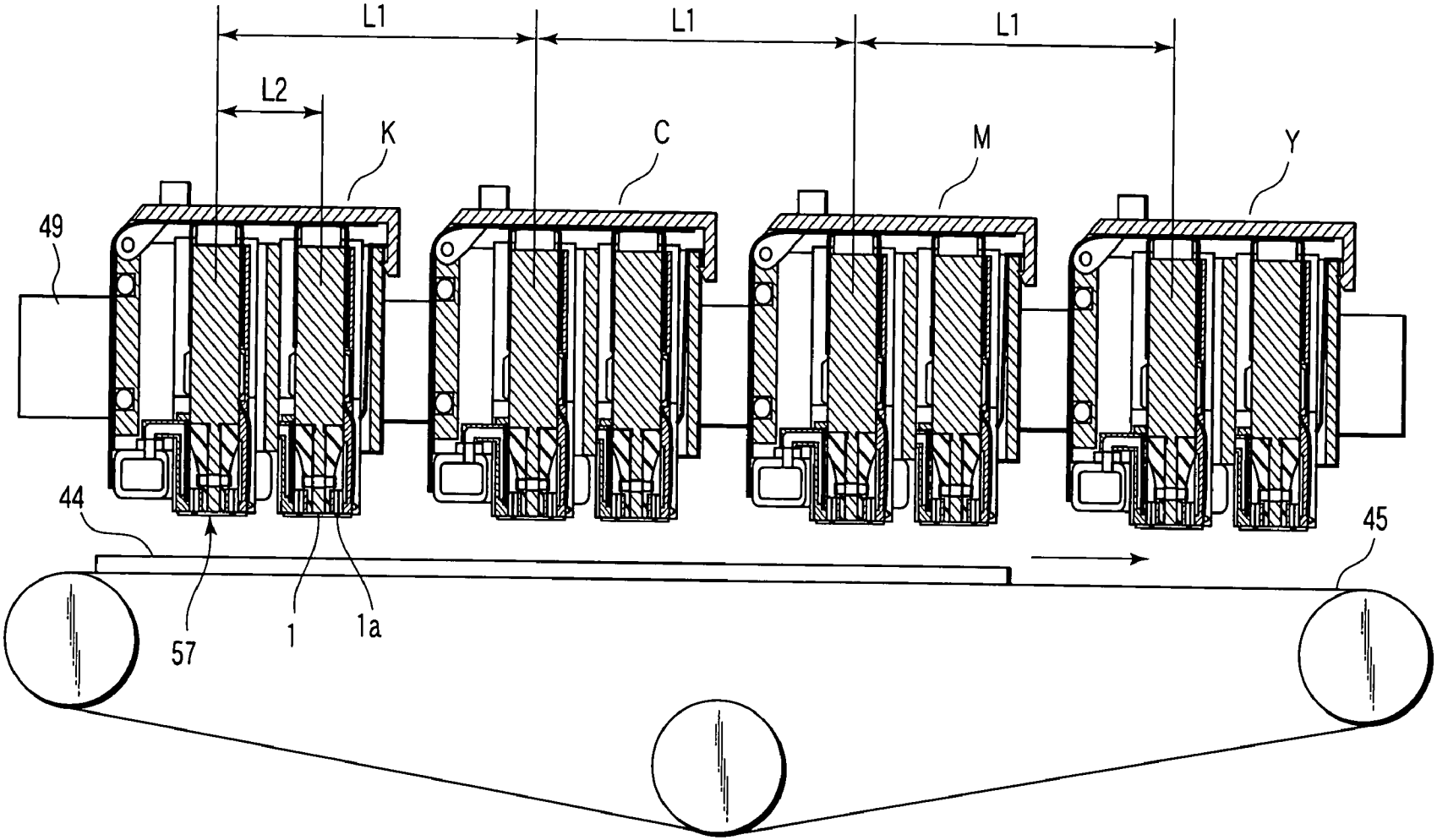
FIG. 30 is a view showing a state in which the head mounts of respective colors are aligned in a recording medium conveying direction.

FIG. 30 is a view showing a state where head mounts 30 of respective colors are arranged in the recording medium conveying direction. The head mounts 30 are arranged in the order of black K, cyan C, magenta M and yellow Y in the recording medium conveying direction. Suction belt carrying means 45 is arranged in such a manner that the recording medium 44 is carried in parallel with the nozzles 1*a* with a distance of approximately 1 mm therebetween.

Figure 27:
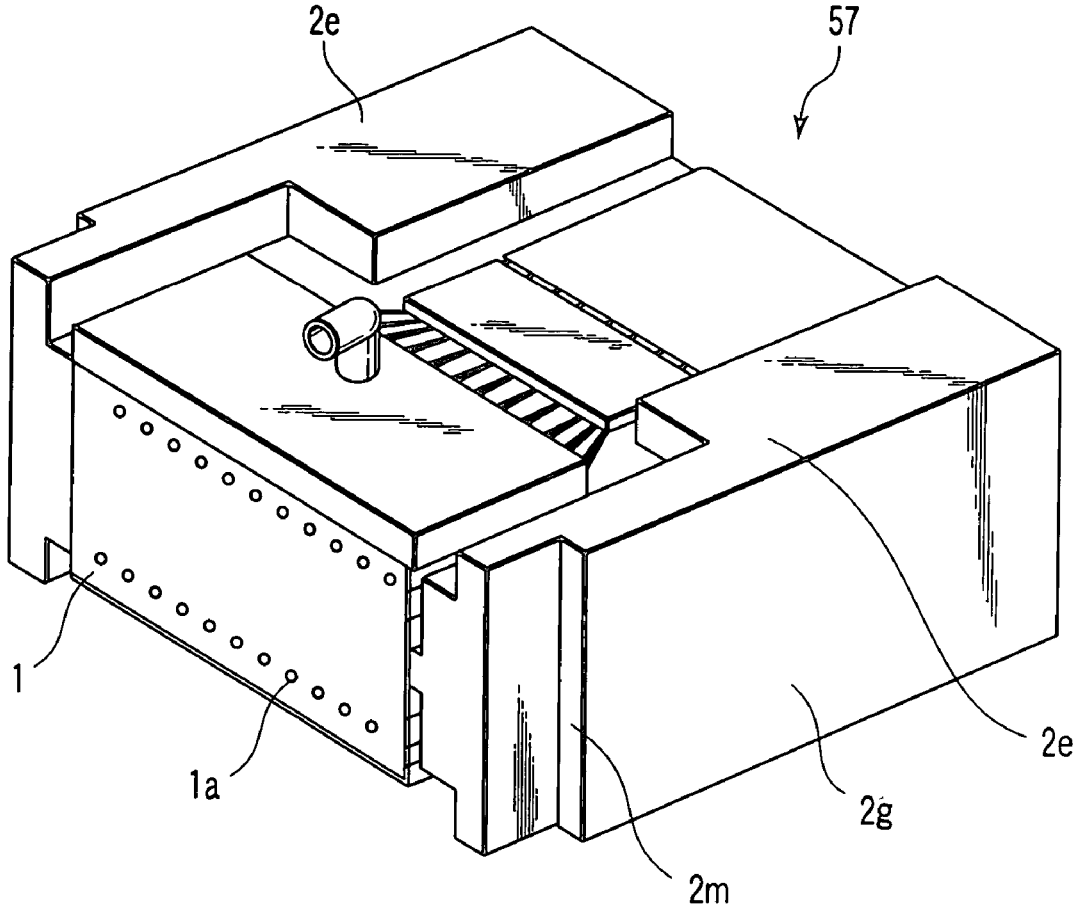
FIG. 27 is a view showing an appearance configuration of the head module from an obliquely upward direction.

In the configuration shown in FIG. 27, a thickness of the part excluding the ink port 8 is approximately 6.5 mm. Therefore, since the ink port 8 of an adjacent head is arranged in a gap between the alternately arranged heads, an inter-head distance L2 in the recording medium conveying direction (FIG. 30) can be set while ignoring the thickness of this ink port portion. In this embodiment, the inter-head distance L2 in the recording medium conveying direction in one head mount can be set to approximately 11 mm. Further, a pitch L1 of the adjacent head mounts can be set to approximately 35 mm.

Figure 31:
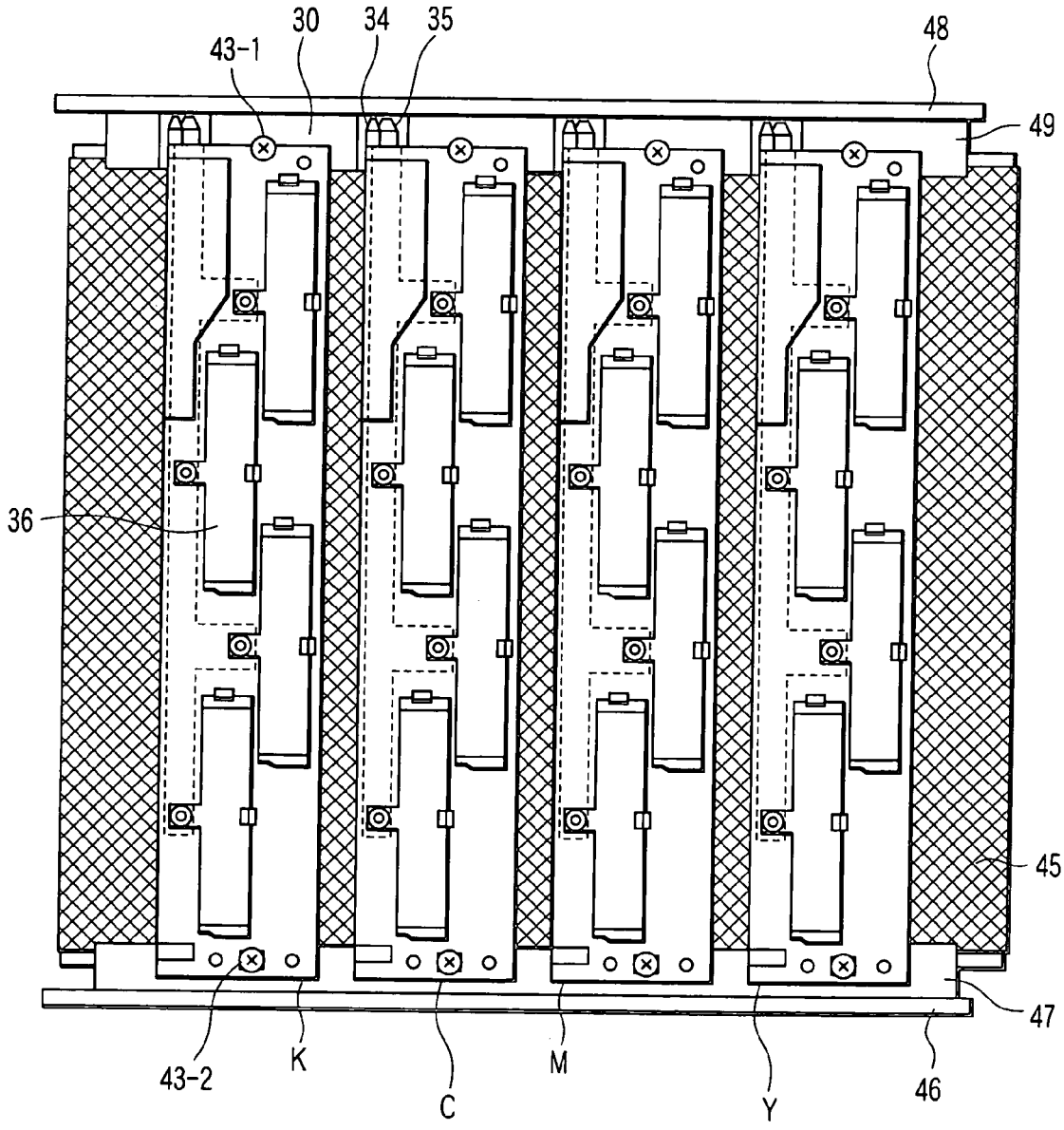
FIG. 31 is a view showing a structural example of the head mounts which form a color image.

Furthermore, FIG. 31 is a view showing a state where the plurality of head mounts 30 are arranged in order to form a color image from a head module attachment/detachment direction.

In this configuration, square log bars 47 and 49 each having a block shape are respectively fixed to frames 46 and 48 facing each other in parallel. Each head mount 30 is fixed in such a manner that its both ends in the longitudinal direction are suspended on these bars. The adjustment screws 43-1 and 43-2 are provided at both ends, and each head mount 30 can be adjusted in the longitudinal direction and a rotation direction. The suction belt carrying means 45 is provided at the lower portion, and each head module 57 inserted into each hole 36 from the upper side is positioned by the head mount 30, and the surface of the nozzle plate 1 of the head module 57 faces the suction belt carrying means 45. The ink joint member 35 which supplies the ink can be coupled with the joint 34 which circulates a coolant through a non-illustrated hole from the outside of the frame 48.

Image formation by the thus configured recording head portion will now be described.

First, the recording medium 44 is sucked by the suction belt carrying means 45 and transmitted below the head mounts 30 arranged in accordance with the respective colors. The recording medium 44 is first transmitted below the head mounts 30 having the ink of black B (Black) and then the other head mounts 30 in the order of cyan C (Cyan), magenta M (Magenta) and yellow Y (Yellow), and the inks of four colors are sequentially ejected, thereby bringing an image to completion. In regard to heat generated when the head modules 57 are driven, a part of heat in the channel portion is taken by the ink and ejected onto the recording medium 44. Any other heat is transmitted to the attachment reference surface 2*a* of the base 2.

Moreover, heat generated from the piezo structures 18 attached on both surfaces in order to achieve 300 dpi is transmitted to the base 2 held in the central part. Heat generated in the drive IC 3 flows toward the base 2, and has the minimum thermal resistance. That is, heat flows to the part having a large thickness and is transmitted to the head mount 30 from the contact surface with respect to the head mount 30. The pipe 39 is brought into contact with the head mount 30 through a grease having excellent thermal conduction properties, and the head mount 30 is cooled by circulation of a cooling medium in the pipe 39 so that a problem due to excessive heating does not occur.

A small difference in temperature of the respective head modules 57 is detected by each thermistor 23, and a volume of an ink drop ejected from each head module 57 can be controlled to be a fixed value by controlling a voltage supplied to each head module 57. Assuming that its control range is ±5° C., circulation of the cooling medium is turned on/off in such a manner that this range is not exceeded, thereby controlling a temperature.

The control target is controlled in accordance with each head mount 30 by making reference to an average temperature, a maximum temperature and a minimum temperature of all the head modules 57. That is, when all the head modules 57 fall within the range of ±5° C., the cooling medium is controlled in such a manner that the average temperature becomes the center of this range. When the maximum temperature exceeds this range, control is carried out in such a manner that the maximum temperature falls within the range. On the other when, the temperature is lower than the minimum temperature, the cooling medium is heated, the head mount 30 is heated and a temperature of the base 2 is increased so that each head module 57 falls within the range of ±5° C.

The ink supplied to each head module 57 is coupled with the ink joint portion 35 from the non-illustrated ink bottle through the tube, and supplied to the channel from the ink path portion 27 through the ink port 8 of each head module 57. The ink path portion 27 is extended on the upstream side alone of the recording medium conveying direction with respect to the head modules 57 alternately arranged in the zigzag pattern, and arranged to supply the ink to the ink port provided at the center of each head from the gap of the respective heads. Therefore, each head module 57 has a compact structure. The ink path portion 27 may be extended on the downstream side alone of the recording medium conveying direction with respect to the head modules 57 alternately arranged in the zigzag pattern. In the head module 57, the ink is supplied to the two piezo structures 18 through the holes 17*a* and 2*d* connecting the pair of attached piezo structures 18.

Since the reservoir 51 is arranged to apply a negative pressure to the nozzle 1*a* of the head, the negative pressure is maintained in a part from the ink path portion 27 to the nozzles 1*a* by a siphon principle, and a meniscus is formed in each nozzle 1*a*.

As described above, an interval of the head arrays constituting one head module 57 is as small as 2.7 mm. Therefore, even if the recording medium slightly obliquely travels, a deviation of a spotting drop position is ½ of a dot pitch, which does not result in a large error.

The head drive substrate 38 is provided to each of the head modules 57 of four colors, and the element which supplies power to each head module 57 is arranged in the vicinity of each head module 57. Therefore, a voltage rarely drops, and the apparatus is resistant to electromagnetic noise. The element 40 which produces the power source is arranged to be embedded in a part between positions where the respective ink portions 8 of the head mount 30 run. As a result, heat generated by the power supply is also removed from the pipe 39 by the cooling medium.

A description will now be given on a replacement procedure when a problem has occurred in the head module 57.

As a problem to be generated, there is clogging of each nozzle 1*a*, electrical disconnection, a damage to the drive IC or the like. First, the hooks 37*b* are disengaged and swiveled around the supporting point 37*a* to open the lid 37, and a corresponding head module 57 alone is manually pulled out in an upward direction. When the ink port 8 comes off the ink joint 27*a* of the ink path portion 27, the head module 57 can be readily pulled out.

Since the inside of the ink path portion 27 has a negative pressure, when even one head module 57 is removed, air enters from the ink joint 27*a*, and the ink drops. Thus, a supply path valve 54 is provided in a part extending from the ink bottle to the joint portion 35, and the supply path valve 54 is closed to then remove the head module 57. As a result, it is possible to prevent the ink from flowing toward the reservoir 51 side from the inside of the ink path portion 27. Since the joint portion with respect to the ink port 8 is the upper side, the ink does not run into the apparatus from the ink path portion 27 which is ink supplying means irrespective of presence/absence of the valve. Further, the head module 57 can be removed while preventing the ink port 8 from coming into contact with any part without contaminating the periphery.

Furthermore, in the head module 57 in a removing process, as shown in FIG. 20, setting a height H from each nozzle 1*a* to the opening portion of the ink port 8 to be low can reduce a positive pressure applied to nozzle 1*a*, whereby the ink does not sweep down from nozzle 1*a*. For example, if a hole diameter of the nozzle 1*a* is not greater than 40 μm, a degree of viscosity of the ink is greater than 4 cP and the height H is not greater than 4 cm, it takes three minutes or more for the ink to sweep down by a positive pressure. This is an enough time in which the head module 57 can be removed. Preferably, when the ink joint 27*a* and the opening portion of the ink port 8 are arranged at positions where the height H is not greater than 2 cm, the left ink does not sweep down from nozzle 1*a*. Moreover, if an inside diameter on the ink port 8 side is not greater than ϕ4 mm, the ink does not sweep down from the ink port 8 side.

A description will now be given as to a case where a new head module 57 is inserted.

In the new head module 57, a position of nozzle 1*a* is produced with a tolerance of approximately 5 μm or below with respect to the surfaces 2*e*, 2*g* and 2*m* (see FIG. 27) as outer shape reference as described above. Therefore, the surface 2*e* is pushed from the rear surface by the spring 25 and the surface 2*g* is pushed by the spring 26 from the other end side so that they come into contact with positioning portions 36*c* and 36*b* of the head mount 30. At last, when the lid 37 is closed, the contact point portion of the head drive substrate 38 provided to the lid 37 pushes the power feed member 10 provided at the uppermost portion of the head module 57.

Additionally, in a state where the lid 37 is closed, the outer shape reference surface 2*m* of the head module 57 is pressed against a determining portion 36*a* of the head mount 30 by the elastic force of the elastic member 10*c*, thereby determining a position in the height direction. At the same time, each emboss 10*a* is pressed against the contact point of the head substrate 38 by this elastic force, thus enabling supply of power and supply of a signal. Further, in a process of pushing down and inserting the head module 57, the ink port 8 is fitted in the ink joint 27*a* of the ink path portion 27. Replacing the head module 57 in this manner enables arrangement of the new head module 57 while maintaining a positional accuracy with respect to any other head module 57.

Then, the atmospheric air opening valve 53 of the reservoir 51 (the ink supply valve 52 is always closed except a supply time of the ink) is closed, and the supply path valve 54 which is precedently closed is opened. As a result, the ink does not drop into the reservoir 51 from the ink path portion 27. When the pressurization pump 55 is pressurized to open the pressurization valve 56 in this state, the inside of the reservoir 51 has a positive pressure, and the ink in the reservoir 51 is supplied into the ink path portion 27.

Then, the ink supplied into the ink path portion pushes out air in the newly replaced and attached head module 57, i.e., air in the joint portion 27*a*. All air bubbles are pushed from the nozzle 1*a* of the head module 57. When the ink is filled in the head module 57, the atmospheric air opening electromagnetic valve 53 is opened. Then, a negative pressure is applied to the nozzle 1*a* portion of the head module 57, and a meniscus is formed, and the apparatus enters a printing enabled state.

The above has described the method of removing air bubbles in the flow path by applying a pressure to the reservoir 51 side. Of course, the present invention is not restricted thereto, and it is possible to adopt a method by which the ink in the ink path portion 27 is filled in the newly replaced head module 57 by known head maintenance means which applies a cap to the nozzle plate 1 side for tight sealing and forms a negative pressure in the cap, thereby sucking the ink from the nozzle 1*a*. Besides the method of controlling opening/closing by using the electromagnetic valve 54, it is possible to adopt a method in which the valve is opened/closed by a manual operation to prevent the ink in the flow path from dropping into the reservoir 51.

The plurality of head modules 57 are arranged in the zigzag pattern, the ink supply opening of each head module 57 is provided in the vicinity of the center of the eject width, the ink supply path of all the head modules 57 are arranged on only one side of the zigzag arrangement in the recording medium conveying direction in the form of the ink path portion, and the ink can be supplied to the head modules 57 apart from the ink path portion 27 through the gap between the heads close to the ink path portion 27. Therefore, the width of the line head having the plurality of heads in the recording medium conveying direction can be reduced, whereby an interval between the plurality of colors can be shortened.

When the ink path portion 27 is seen in a distance from the recording medium, the ink path portion is arranged between the nozzle 1*a* of the head module 57 and the ink port 8, and the ink path portion 27 and the head module 57 match with each other by inserting the head module 57 from the upper side. Therefore, at the time of removable/attachment of the head module 57, the head module 57 can be readily removed/attached without interference of the ink supply path.

The distance between the ink port 8 opening and the nozzle 1*a* is set to 4 cm or below and the ink path portion 27 is arranged at the position where the inside diameter of the ink port 8 is not greater than ϕ4 mm. Therefore, at the time of removal/attachment of the head module 57, the ink can be prevented from sweeping down from the opening of the ink port 8 or the nozzle 1*a* of the head module 57.

The pressurizing or sucking means for filling the replaced head ink is provided with respect to the plurality of head modules 57 replaceably arranged in the head mount 30, and the head module 57 is replaced with the supply path valve 54 for the head mount 30 being closed. After replacement, the supply path valve 54 is controlled to be opened in a state where a pressure for supplying the ink to the nozzle 1*a* is generated by the pressurizing or sucking means. As a result, an amount of air mixed in the ink path portion 27 which is coupled with the plurality of head modules 57 can be suppressed to the minimum level, and the ink can be filled in the replaced head module 57 with the minimum amount of a waste liquid.

When the supply path valve 54 is opened after the atmospheric air opening electromagnetic valve 53 of the reservoir 51 is closed, the ink in the ink path portion 27 can be prevented from dropping into the reservoir 51 side, the ink can be efficiently filled in the replaced head module 57, and the ink can be filled in the replaced head module 57 with the minimum amount of the waste liquid.

Figure 32A:
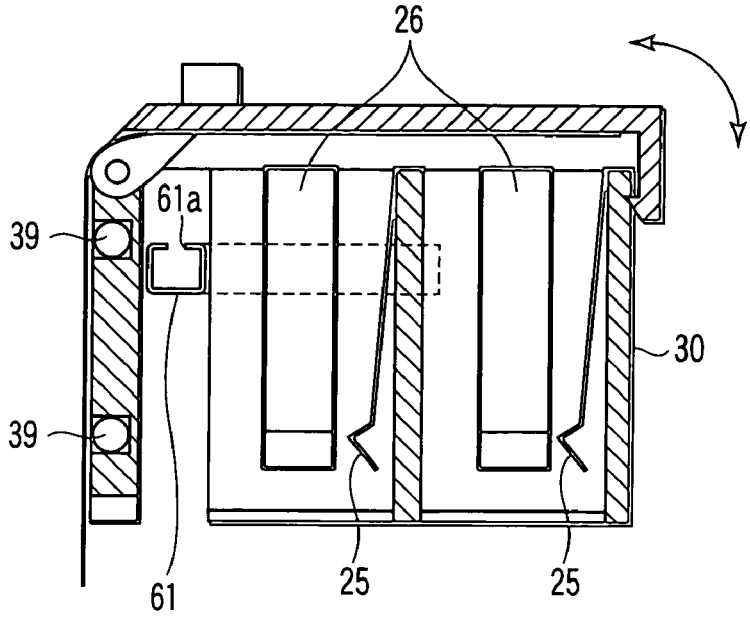
FIGS. 32A and 32B are views showing cross-sectional configurations in states where head modules are not inserted into a head mount and where the head modules are inserted into the head mount according to a third embodiment.
Figure 32B:
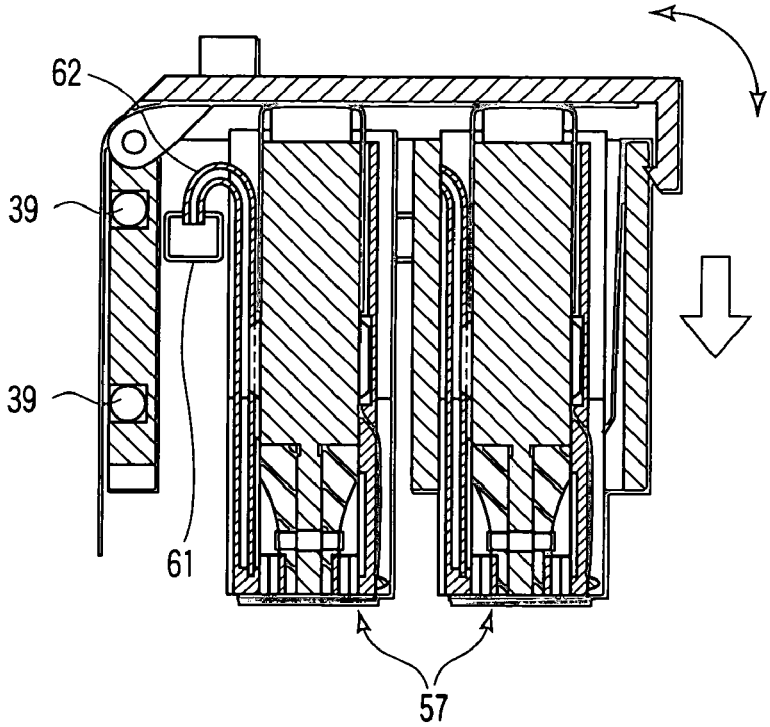

FIGS. 32A and 32B are views showing cross-sectional configurations in states where head modules are not inserted into a head mount and where the head modules are inserted into the head mount according to a third embodiment.

This embodiment is different from the constitution shown in FIGS. 25A and 25B in the arrangement of the ink path portion and the configuration the ink joint.

In an intermediate position of the head mount 30, the ink pass portion 61 extends in a line in a width direction of a recording medium. On the uppermost surface of the ink path portion 61, an opening portion 61*a* is disposed. An end portion of an ink port 62 of the head module 57 is provided with a tube made of a resin, a rubber or the like having elasticity. The ink port 62 is inserted into the opening portion 61*a*, whereby the head module 57 can be linked with the ink path portion without any leakage of the ink.

That is to say, when the head module 57 is inserted as shown in FIG. 32B, a tip portion of the ink port 62 is inserted into the opening portion 61*a* in the same direction as the inserting direction of the head module 57, whereby the ink can be supplied from the opening portion 61*a* to the entire head module 57 via the ink path portion 61.

The opening portion 61*a* is provided on the uppermost surface of the ink path portion 61, and therefore, attachment operation is easy, and bubbles can easily be discharged and constitution can easily be realized. Needless to say, such a joint constitution as in the above embodiment may also be employed.

According to the above-described structure, the following effects can be obtained.

1. Since the plurality of head modules 57 are arranged in the direction orthogonal to the recording medium conveying direction and the ink supplying means for the plurality of head modules 57 is arranged on one of the upstream side and the downstream side of the recording medium conveying direction, the width of the line head having the plurality of heads in the recording medium conveying direction can be reduced, thereby shortening an interval between a plurality of colors.

2. When the ink path portion is seen in a distance from the recording medium, arranging the ink path portion between the nozzles of the head module 57 and the ink port and inserting the head modules 57 from the upper side allows the ink path portion and the head modules 57 to match with each other. Therefore, at the time of removal/attachment of the head module 57, the head can be readily removed/attached without interference of the ink supply path.

3. The pressurizing or sucking means for filling the head ink 57 in a replaced head is provided with respect to the plurality of head modules 57 replaceably arranged in the head mount 30, the ink supply valve of the head mount 30 is closed to replace the head module 57, and the valve is controlled to be opened in a state where a pressure for supplying the ink to the nozzles is generated by the pressurizing or sucking means after replacement. As a result, an amount of air mixed in the ink path portion coupled with the plurality of head modules 57 can be suppressed to the minimum level, and the ink can be filled in the replaced head with the minimum amount of a waste liquid.

According to the present invention, it is possible to provide image formation including the recording head portion in which the plurality of small heads are alternately arranged in such a manner that their end portions overlap each other to constitute the virtual elongated line head and each head can be individually replaced by easy removal/attachment.

What is claimed is:

1. An image forming apparatus having:

a fixing member which holds nozzle arrays of a plurality of head modules which eject ink at predetermined positions where the nozzle arrays are arranged in a direction crossing a conveying direction of a recording medium, the plurality of head modules constituting one head module group which ejects the ink to the recording medium to be carried, thereby forming an image;

an ink path portion which is arranged and coupled to one of an upstream side and a downstream side of the conveying direction of the recording medium with respect to the plurality of head modules, and supplies the ink to the plurality of head modules;

a first joint portion which is provided to each of the plurality of head modules and functions as an ink receiving opening; and a second joint portion which is a part of the ink path portion and detachably engaged with the first joint portion to function as an ink supply opening, wherein, when the plurality of head modules move in a first direction crossing a recording surface of the recording medium to be held at the predetermined positions of the fixing member, the first joint portion is fitted in and engaged with the second joint portion in the first direction.

2. The image forming apparatus according to claim 1, wherein the head module group has:

at least two head module arrays in which end portions of a plurality of head modules shorter than a width of the recording medium overlap adjacent head module end portions as seen from the conveying direction of the recording medium, and are arranged in parallel with the recording surface of the recording medium in the conveying direction of the recording medium.

3. The image forming apparatus according to claim 2, wherein the first joint portion protrudes from a non-overlapping portion of the plurality of head modules.

4. The image forming apparatus according to claim 2, wherein the ink path portion has a bulged portion having the second joint portion provided thereto in such a manner that the bulged portion enters a gap between the head modules in the head module array closer to the ink path portion in the head modules arrays arranged in at least two arrays, and the bulged portion has a bulged length which allows engagement of the second joint portion with respect to the first joint portion.

5. The image forming apparatus according to claim 1, wherein the first direction is a direction along which the head modules move closer to the recording medium.

6. The image fixing apparatus according to claim 5, wherein the fixing member has openings in a direction where the plurality of head modules are attached, the opening at one end faces the recording medium, and each of the plurality of head modules can be inserted and attached from the opening at the other end.

7. The image forming apparatus according to claim 1, wherein the second joint portion is arranged at an uppermost portion of the ink path portion in a direction of a gravitational force.

8. The image forming apparatus according to claim 1, wherein the ink path portion has an openable/closable valve.

9. The image forming apparatus according to claim 1, wherein the head modules are fixed to the fixing member by elastic force of at least an elastic member.

10. The image forming apparatus according to claim 1, wherein the fixing member has a temperature control member which adjusts a temperature of the ink path.

* * * * *